US008505903B2

(12) United States Patent
Hattori

(10) Patent No.: US 8,505,903 B2
(45) Date of Patent: Aug. 13, 2013

(54) SHEET FOLDING DEVICE, IMAGE FORMING SYSTEM, AND SHEET FOLDING METHOD

(75) Inventor: Minoru Hattori, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 29 days.

(21) Appl. No.: 13/347,170

(22) Filed: Jan. 10, 2012

(65) Prior Publication Data

US 2012/0184423 A1 Jul. 19, 2012

(30) Foreign Application Priority Data

Jan. 18, 2011 (JP) ..... 2011-007877

(51) Int. Cl.
*B41L 43/00* (2006.01)

(52) U.S. Cl.
USPC ..... 270/45; 270/32; 270/58.07

(58) Field of Classification Search
USPC ..... 270/32, 45, 58.07; 493/406, 407, 493/416, 422, 424, 436
See application file for complete search history.

(56) References Cited

U.S. PATENT DOCUMENTS

| | | | | |
|---|---|---|---|---|
| 6,511,407 | B2 * | 1/2003 | Wahl | 493/405 |
| 7,731,187 | B2 | 6/2010 | Horio et al. | |
| 7,744,076 | B2 | 6/2010 | Suzuki et al. | |
| 2007/0176357 | A1 | 8/2007 | Horio et al. | |
| 2008/0284092 | A1 | 11/2008 | Suzuki et al. | |
| 2010/0310340 | A1 | 12/2010 | Suzuki et al. | |
| 2011/0103921 | A1 | 5/2011 | Suzuki et al. | |
| 2011/0229287 | A1 | 9/2011 | Suzuki | |
| 2011/0301009 | A1 * | 12/2011 | Hattori et al. | 493/405 |
| 2012/0065044 | A1 * | 3/2012 | Tsuno | 493/416 |

FOREIGN PATENT DOCUMENTS

| | | | |
|---|---|---|---|
| JP | 3254363 | B2 | 7/1997 |
| JP | 3623573 | B2 | 7/1997 |
| JP | 2000143081 | A | 5/2000 |
| JP | 3824985 | B2 | 4/2004 |
| JP | 2004210436 | A | 7/2004 |
| JP | 2010006602 | A | 1/2010 |

OTHER PUBLICATIONS

Abstract of JP 2004-106990 published Apr. 8, 2004.
Abstract of JP 09-183566 published Jul. 15, 1997.
Abstract of JP 09-183567 published Jul. 15, 1997.
Abstract of JP 2004-210436 published Jul. 29, 2004.
Abstract of JP 2000-143081 published May 23, 2000.
Abstract of JP 2010-006602 published Jan. 14, 2010.

* cited by examiner

*Primary Examiner* — Leslie A Nicholson, III
(74) *Attorney, Agent, or Firm* — Harness, Dickey & Pierce, P.L.C.

(57) ABSTRACT

A sheet folding device that performs a folding process on a bundle of sheet members includes: a folding unit that folds the bundle of the sheet members; a pushing unit that abuts on a surface of the bundle of the sheet members so as to push the bundle of the sheet members into the folding unit; pressing plates that form a pair, that have convexly curved surfaces to face each other, and that form a crease by pressing the bundle of the sheet members therebetween; a driving unit that performs a pressing operation and a press-releasing operation of the pair of the pressing plates; a moving unit that moves a pressing position of the pair of the pressing plates interposing the bundle of the sheet members; and a control unit that controls the driving unit and the moving unit. The control unit controls a moving speed of the pressing position.

10 Claims, 14 Drawing Sheets

SHEET FOLDING DEVICE, IMAGE FORMING SYSTEM, AND SHEET FOLDING METHOD

CROSS-REFERENCE TO RELATED APPLICATIONS

The present application claims priority to and incorporates by reference the entire contents of Japanese Patent Application No. 2011-007877 filed in Japan on Jan. 18, 2011.

BACKGROUND OF THE INVENTION

1. Field of the Invention

The present invention relates to a sheet folding device that performs a sheet folding process on a sheet-like member (hereinafter, simply referred to as a "sheet") such as a sheet of paper, transfer paper, or an overhead projector (OHP) sheet; an image forming system that includes the sheet folding device and an image forming apparatus such as a copying machine, a printer, a facsimile, or a digital multi-function peripheral; and a sheet folding method that is performed in the sheet folding device.

2. Description of the Related Art

With regard to a so-called post-processing peripheral that performs a predetermined process on a sheet discharged from an image forming apparatus such as a copying machine, Japanese Patent Application Laid-open No. 2004-210436 or Japanese Patent Application Laid-open No. 2000-143081 discloses the technology of performing center-binding on a plurality of sheets with a staple and folding the sheets in half (hereinafter, referred to as "center-binding fold") by pressing the sheets using pressing rollers or pressing plates.

In particular, Japanese Patent Application Laid-open No. 2004-210436 discloses an invention of the booklet forming device that performs a half-fold pressing process on a set of sheets. The booklet forming device includes: a push blade that pushes a folding-line position of paper placed on a sheet table in the direction perpendicular to a surface of the paper; a stopper plate that receives the paper pushed by the push blade; and a pair of press blades that are disposed at both sides of a movement path of the push blade and are driven obliquely from a standby position toward a push blade landing position on the stopper plate. Then, the paper is made to be abutted on the stopper plate at the folding-line position by the push blade while the paper is kept to be folded in half, and both sides of the folded portion of the paper are pressed by the press blades so as to form the spine of a booklet.

Furthermore, Japanese Patent Application Laid-open No. 2000-143081 discloses an invention of the sheet post-processing device that binds a sheet bundle at the center position in the conveying direction, operates a folding blade at nearly the same position as the folding position of the bound sheet bundle so as to fold the bound sheet bundle and makes a bound booklet by enhancing the folded state of the sheet bundle by being nipped by a pair or a plurality of pairs of press rollers while the bound sheet bundle is being conveyed. The sheet post-processing device includes a cutting unit that evenly cuts the edge portion of the center-bound booklet on the opposite side of the bound side and that is provided at the upstream position with respect to a roller serving as the final press roller among the press rollers in the conveying direction of the center-bound booklet, and sets a position of the center-bound booklet to be cut to the cutting position of the center-bound booklet while at least part of the press rollers nip the bound sheet bundle, thereby to perform a cutting operation.

Furthermore, Japanese Patent Application Laid-open No. 2010-6602 discloses, with the aim of providing a center-binding folding device capable of forming a center-bound and -folded booklet having a sharp crease quickly, a center-binding-folding mechanism that includes: a folding unit that folds a sheet bundle in half; a pressing unit that stops the half-folded sheet bundle at a predetermined position and applies pressure to the crease of the stopped sheet bundle from the front and rear faces of the sheet bundle interposed between the pressing surfaces facing each other; and a pressing number control unit that determines the number of times the pressing unit is to perform a pressing operation for applying pressure to the crease of the sheet bundle and that controls the pressing unit so that the pressing unit performs the pressing operation for the determined number of times.

However, when the press-folding operation is performed by pressing and stroking the paper (sheet) bundle with the leading end of the press blade as in the invention disclosed in Japanese Patent Application Laid-open No. 2004-210436, there has been a problem in that damage such as a scratch or wrinkle may occur on the surface of the center-bound paper (sheet) bundle due to the pressing or stroking.

Furthermore, when the folding operation is performed by the pair of folding rollers as in the invention disclosed in Japanese Patent Application Laid-open No. 2000-143081, in the sheet folding mechanism that inserts the sheet or the sheet bundle from the creasing position into the nip between the pair of folding rollers using the folding blade to fold and align the sheet bundle, a wrinkle folding phenomenon occurs at the trailing edge side of the sheet when the sheet or the sheet bundle is folded and aligned at the creasing position by the folding roller. At this time, because the folding roller has a round shape, it is difficult to keep the roller pressure across the folding roller uniform while the sheet bundle is conveyed by the pressure applied by the folding roller through the way from the folding operation to the completion of the conveying operation. Therefore, the deformation or the displacement has been accumulated in the sheet bundle due to the non-uniform roller pressure, thereby to cause a wrinkle on the sheet bundle.

Because uniformity and balancing are required for the pressure of the folding roller, as described above, there has been a problem in that the precise configuration of the folding roller in the parallelism between the circumference and the axis of rotation of the folding roller makes the production of the folding roller difficult and costly, the weight thereof is heavy due to the increased rigidity, and a high level of skill is required for the adjustment thereof.

Furthermore, the invention disclosed in Japanese Patent Application Laid-open No. 2010-6602 is configured such that, after the folding operation is performed by the folding roller, the fold increasing operation is performed with a pressing surface at the pressing unit provided in the downstream of the folding roller in the conveying direction. However, the paper is folded with the folding roller; the folding roller is very expensive, the weight is heavy due to the increased rigidity, and a high level of skill is required for the adjustment as in the invention disclosed in Japanese Patent Application Laid-open No. 2000-143081. In addition, the invention relates to a mechanism that performs a process of further applying pressure to the folded bundle with the pressing surface after the folding process, and the requirement of performing an additional process for applying the pressure to the folded bundle after the folding process inevitably reduces the productivity. The reduction in the productivity becomes more apparent when the pressing operation is performed a plurality of times in accordance with the number of sheets.

Therefore, there is a need to form a crease with high quality using a low-cost mechanism without causing damage such as a wrinkle or a scratch on the sheet or a reduction in the productivity.

SUMMARY OF THE INVENTION

It is an object of the present invention to at least partially solve the problems in the conventional technology.

A sheet folding device that performs a folding process on one of a sheet member and a bundle of sheet members includes: a folding unit that folds the one of the sheet member and the bundle of the sheet members; a pushing unit that is formed like a plate and that abuts on a surface of the one of the sheet member and the bundle of the sheet members so as to push the one of the sheet member and the bundle of the sheet members into the folding unit; pressing plates that are provided to form a pair, that have convexly curved surfaces to face each other, and that form a crease at a center portion of the one of the sheet member and the bundle of the sheet members by interposing and pressing the one of the sheet member and the bundle of the sheet members having been pushed into the folding unit therebetween; a driving unit that performs a pressing operation and a press-releasing operation of the pair of the pressing plates; a moving unit that moves a pressing position of the pair of the pressing plates interposing the one of the sheet member and the bundle of the sheet members; and a control unit that controls the driving unit and the moving unit. The control unit controls a moving speed of the pressing position moved by the moving unit.

An image forming system includes an image forming device and a sheet folding device. The image forming device forms a visible image on a sheet member, and the sheet folding device performs a folding process on one of the sheet member and a bundle of the sheet members. The sheet folding device includes: a folding unit that folds the one of the sheet member and the bundle of the sheet members; a pushing unit that is formed like a plate and that abuts on a surface of the one of the sheet member and the bundle of the sheet members so as to push the one of the sheet member and the bundle of the sheet members into the folding unit; pressing plates that are provided to form a pair, that have convexly curved surfaces to face each other, and that form a crease at a center portion of the one of the sheet member and the bundle of the sheet members by interposing and pressing the one of the sheet member and the bundle of the sheet members having been pushed into the folding unit therebetween; a driving unit that performs a pressing operation and a press-releasing operation of the pair of the pressing plates; a moving unit that moves a pressing position of the pair of the pressing plates interposing the one of the sheet member and the bundle of the sheet members; and a control unit that controls the driving unit and the moving unit. The control unit controls a moving speed of the pressing position moved by the moving unit.

A sheet folding method includes: pushing performed by a plate-like pushing unit that pushes one of a sheet member and a bundle of sheet members into a folding unit by abutting on a surface thereof; interposing the one of the sheet member and the bundle of the sheet members having been pushed into the folding unit by the pushing between a pair of pressing plates whose mutually facing surfaces are convexly curved to each other, pressing a pressed position interposed between the pair of the pressing plates while the pressed position is being moved, and forming a crease at a center portion of the one of the sheet member and the bundle of the sheet members; and changing a moving speed of the pressed position based on sheet information that includes at least one of number of the sheet members, thickness of the sheet members, and a size of the sheet members when the crease is formed by the forming.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is viewed from an opposite side and is an enlarged view further magnifying an attachment portion of a clamp-releasing motor;

DETAILED DESCRIPTION OF THE PREFERRED EMBODIMENTS

The present embodiment provides a mechanism for a folding process that folds a sheet by keeping the sheet in a stopped state, by pressing the sheet with curved pressing plates, and by moving a pressing nip position on the sheet. In the mechanism, the moving speed of the nip formed between the pressing plates is changed in accordance with condition such as number of sheets to be folded and size of the sheet, and the folding operation is performed by pressing the sheet once or a plurality of times with the pressing plates so as to form a sharp crease on the sheet.

Hereinafter, the embodiment will be described in detail with reference to the accompanying drawings.

Figure 1:
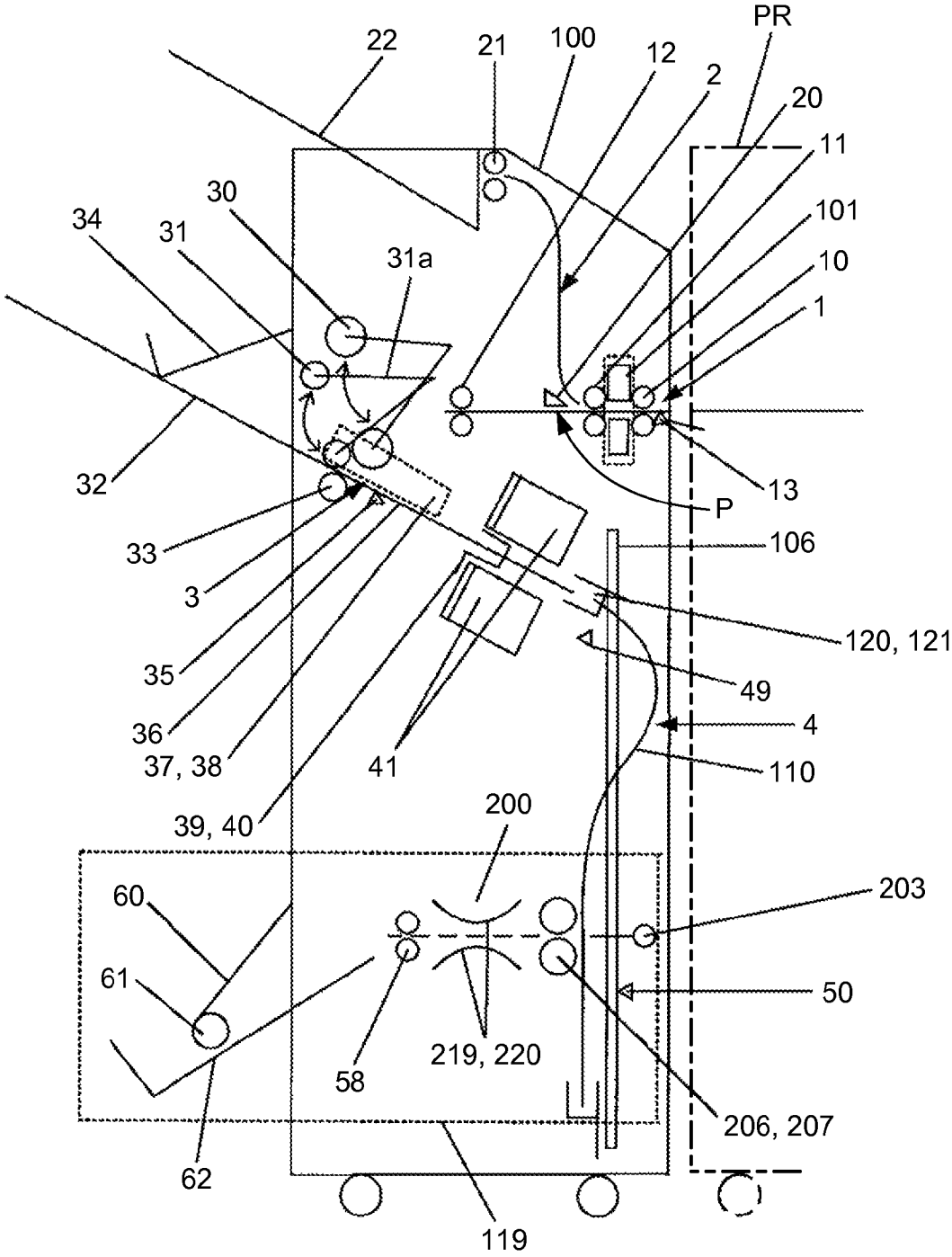
FIG. 1 is a diagram illustrating a system configuration of an image forming apparatus according to an embodiment.

FIG. 1 is a diagram illustrating the configuration of a system of an image forming apparatus according to the embodiment. The image forming apparatus according to the embodiment includes an image forming device PR and a sheet post-processing device 100 provided downstream of the image forming device PR and serving as a sheet processing device. The image forming device PR includes, for example, an image forming unit (not illustrated) that forms an image by an electrophotographic process and a feeding unit that supplies a sheet to the image forming unit, and has a function of printing or forming an image on the sheet on the basis of information transmitted from a personal computer (PC), information read by a scanner, or information stored in a hard disk included in the image forming device PR. For the image forming unit, a known image forming method is employed; one example is a droplet ejection method such as an ink-jet method, and the other example is a thermal method. However, a method utilizing the electrophotographic process is not employed in the image forming unit. Therefore, in FIG. 1, only an external form of a casing of the image forming device PR on a side of the sheet post-processing device is outlined by a dashed-dotted line.

The sheet post-processing device 100 includes a first conveying path (an entrance conveying path) 1 that receives a sheet discharged from the image forming device PR after an image has been formed thereon, a second conveying path 2 that is used for stacking the sheet onto a discharge tray 22, a third conveying path 3 that used for intermediate stacking of the sheet, and a fourth conveying path 4 that conveys a bundle of sheets obtained by center-binding the center portion of the sheets in the length direction in the third conveying path 3 to a sheet folding unit.

On the first conveying path 1, an entrance roller 10 and an entrance sensor 13 are provided. The entrance sensor 13 detects whether the sheet is conveyed into the sheet post-processing device 100. A sheet punching unit 101 is provided downstream of the entrance roller 10. First and second conveying rollers 11 and 12 are provided downstream of the sheet punching unit 101 in this order along the conveying direction. The sheet P is conveyed to the third conveying path 3 by the first and second conveying rollers 11 and 12.

The second conveying path 2 is a path to convey the sheet to the discharge tray 22 and is a path branching upward from the first conveying path 1 with a branching claw 20 provided at a branch point. The sheet P, of which the moving direction is changed by the branching claw 20 from the first conveying path 1, is conveyed from a first conveying roller 11 to the discharge tray 22 through a discharging roller 21.

On the third conveying path 3, a discharge driven roller 31, a discharge driving roller 33, and a discharge sensor 35 are provided. In a sort mode, when a second conveying roller 12 equipped with a shifting mechanism is moved by a predetermined amount in the direction perpendicular to the conveying direction during the conveyance by a driving unit (not illustrated), the sheet P is shifted by a predetermined amount, discharged onto a discharge tray 32 by the discharge driving roller 33, and sequentially stacked thereon. A discharge opening portion to the discharge tray 32 nips the sheet P or the sheet bundle PB by using the discharge driving roller 33 and the discharge driven roller 31, and discharges the sheet P or the sheet bundle PB by applying a conveying force thereto. This discharging operation can be switched between a closed state where the sheet P or the sheet bundle PB is nipped to be discharged and an open state where the sheet P or the sheet bundle PB is not nipped, by contacting and separating operations of a discharge guide 31*a*, equipped with the discharge driven roller 31, with and away from the discharge driving roller 33, respectively. After the shifting operation of the sheet P is completed, the discharge guide 31*a* is operated so as to nip the sheet P between the discharge driven roller 31 and the discharge driving roller 33, thereby the sheet P is discharged onto the discharge tray 32.

A filler 34 is provided near a position above the discharge opening, and a base end thereof is rotatably attached to the sheet post-processing device 100 so that the leading end thereof comes into contact with a position near the center of the sheet P when the sheet P is stacked onto the discharge tray 32. A top surface detecting sensor (not illustrated) is provided near the base end of the filler 34 so as to detect the height position of the leading end of the filler 34, that detects the height of the top surface of the stacked sheets.

When the top surface detecting sensor is turned on as the height of the top sheet increases with an increase in the number of sheets stacked on the discharge tray 32, a control unit (not illustrated) moves the discharge tray 32 downward by controlling a driving unit (not illustrated) that moves the discharge tray 32 up and down. When the discharge tray 32 moves down and the top surface detecting sensor is turned off, the control unit stops the downward movement of the discharge tray 32. By repeating this operation, when the discharge tray 32 reaches a prescribed tray-filled height, a stop signal is output from the sheet post-processing device 100 to the image forming device PR, thereby the image forming operation of the image forming device PR is stopped.

On the third conveying path 3, a staple tray 36 and a hitting roller 30 are provided. At an end position of the third conveying path 3, is provided a stapler 41 that is divided into a clincher and a driver that moves back and forth in the direction perpendicular to the sheet surface. Furthermore, jogger fences 37 and 38 are provided upstream of the end position so as to move back and forth in the direction perpendicular to the sheet surface and align the sheets on the staple tray 36. The sheets having been conveyed to the third conveying path 3 are discharged onto the staple tray 36, and the positions thereof may be aligned in a width direction by the jogger fences 37 and 38.

Furthermore, the hitting roller 30 abuts on the top surface of the sheets while performing a pendulum motion so as to swing back in the direction toward the stapler 41, and allows the trailing end of the sheet to abut on reference fences 39 and 40 so that the positions of the sheets in the sheet bundle may be aligned in the longitudinal direction (the conveying direction). In an end-binding mode, the sheet bundle PB that has been aligned as above is bound by the stapler 41 that moves in the direction perpendicular to the sheet surface and staples an appropriate position at a lower edge of the sheet bundle PB, nipped between the discharge driven roller 31 and the discharge driving roller 33 so as to be applied a conveying force, thereby the sheet bundle PB is discharged onto the discharge tray 32.

In a center-binding mode, after the sheet P or the sheet bundle PB is aligned and stapled, the trailing end of the sheet bundle PB is nipped by clamp-movable fences 120 and 121, and the reference fences 39 and 40 are retracted outside the sheet width so as not to disturb the conveying operation of the sheet bundle PB. The clamp-movable fences 120 and 121 are attached to a longitudinal clamp shaft 106 disposed outside a side plate of the apparatus, and move in a longitudinal direction (the up-down direction) and also in a transverse direction (the horizontal direction: the left-right direction in FIG. 1) along a curved fourth conveying path 4.

The clamp-movable fences 120 and 121 is moved in the longitudinal direction by the longitudinal clamp shaft 106, and move in the transverse direction along a guide rail 110, disposed at the side plate of the apparatus, that has a same trace as a curved trace of the fourth conveying path 4, whereby the sheet bundle PB is conveyed along the conveying path 4. The sheet bundle PB nipped at the trailing end is conveyed to a predetermined position corresponding to the sheet size along the track of the guide rail 110, and an appropriate position in the center portion of the sheet bundle in the length direction is stapled, thereby the sheet bundle PB is center-bound. The predetermined position corresponding to the sheet size is a position set by a predetermined pulse that has been transmitted from a clamp-movable fence home position sensor 49.

The center-bound bundle PB is conveyed further downward by the clamp-movable fences 120 and 121, and is stopped at a position where the center of the sheet in the length direction is positioned at a folding blade 203. Then, a folding process is started. The stopped position is a position where the trailing end of the sheet is detected by a first folding position sensor 50 and is moved by an amount set by a predetermined pulse corresponding to the sheet size. Subsequently, the center portion, in the length direction, of the sheet bundle stopped at the folding position is guided into a press-folding unit 200 by the folding blade 203 and conveying rollers 206 and 207.

The sheet bundle guided into the press-folding unit 200 is center-folded by pressing the center portion of the sheet bundle in the length direction from above and below using upper and lower pressing plates 219 and 220. The center-folded sheet bundle PB is discharged onto a center-binding tray 62 by the conveying rollers 206 and 207 and a discharging roller 58.

The sheet bundle PB having been discharged onto the center-binding tray 62 is pressed by a sheet pressing roller 61 attached to a sheet presser 60 so as to prevent the folded sheet from expanding to become an obstacle to a next sheet discharging operation.

The sheet punching unit 101 and the center-folding unit 119 that includes the conveying path 4 are configured to be attachable and detachable, thereby capable of providing a sheet post-processing device in accordance with a user's demand.

Figure 2:
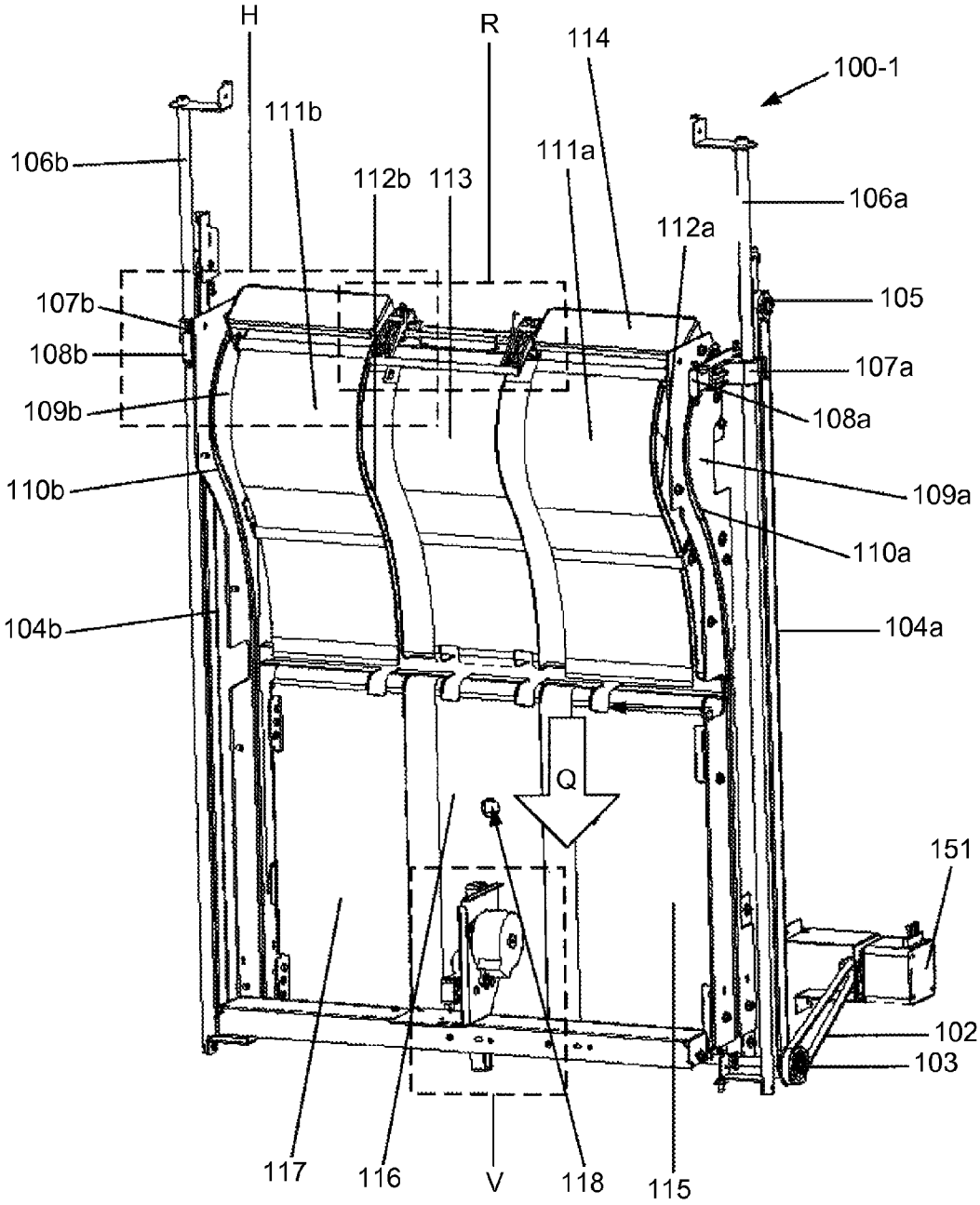
FIG. 2 is a perspective view illustrating an entire configuration of a clamp bundle conveying unit.

FIG. 2 is a perspective view illustrating the entire configuration of a clamp bundle-conveying unit.

A clamp bundle-conveying unit 100-1 includes conveying guide plates 111*a*, 111*b*, 112*a*, 112*b*, 113, 115, 116, and 117, side plates 109*a* and 109*b* on which rails 110*a* and 110*b* are respectively formed, a clamp-moving motor 151, a driving belt 102, a lower vertical driving pulley 103, an upper vertical driving pulley 105, vertical conveying belts 104*a* and 104*b*, vertical clamp-moving members 107*a* and 107*b*, horizontal clamp-moving elements 108*a* and 108*b*, and the like. Rotational driving force exerted by the clamp-moving motor 151 is converted into a vertical movement by the driving belt 102, the vertical conveying belt 104*a* that is suspended between the lower vertical driving pulley 103 and the upper vertical driving pulley 105, and the vertical conveying belt 104*b* that is suspended on an opposite side of the clamp bundle-conveying unit 100-1.

The vertical clamp-moving members 107*a* and 107*b* are attached to the vertical conveying belts 104*a* and 104*b*, and the vertical movement thereof is supported by shafts 106*a* and 106*b*, respectively. The horizontal clamp-moving members 108*a* and 108*b* are attached to the vertical clamp-moving members 107*a* and 107*b* so as to be movable in the transverse direction.

A clamp stay 114 is connected to the horizontal clamp-moving members 108*a* and 108*b*, and the clamp stay 114 moves in the direction indicated by the arrow Q along the rails 110*a* and 110*b* of the side plates 109*a* and 109*b* in association with the vertical movement of the vertical conveying belts 104*a* and 104*b*. The sheet bundle PB whose trailing end is nipped by the clamp portion is conveyed through a conveying path formed by the conveying guide plates 111*a*, 111*b*, 112*a*, 112*b*, 113, 115, 116, and 117. The sheet bundle PB is detected by a second folding position sensor 118, and the conveying operation thereof is stopped at a predetermined position.

Figure 3:
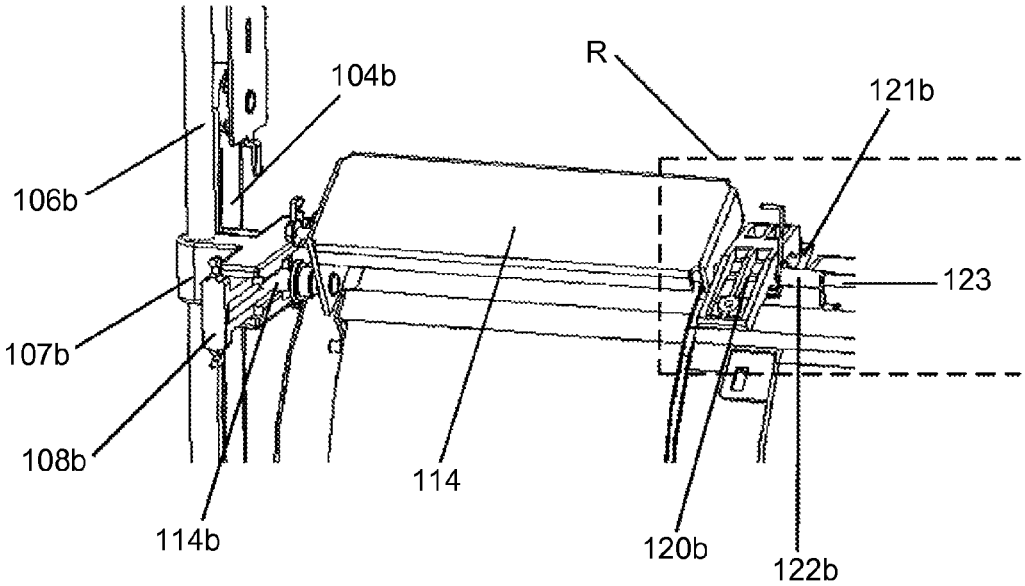
FIG. 3 is an enlarged view of a main part illustrating a portion H that includes an upper portion of a conveying guide plate enclosed by one of the dotted lines in FIG. 2.

FIG. 3 is the main enlarged view of the main part illustrating a portion H that includes an upper portion of the conveying guide plate 111*b* enclosed by one of the dotted lines in FIG. 2.

In FIG. 3, the horizontal clamp-moving member 108*b* is inserted into the vertical clamp-moving member 107*b* on the left side of FIG. 2 such that the horizontal clamp-moving member 108*b* is slidable inside the vertical clamp-moving member 107*b* in a back-and-forth manner in FIG. 3. A first clamp stay shaft 114*b* is inserted into the horizontal clamp-moving member 108*b*, and the clamp stay 114 is movable, while moving up and down, in the transverse direction (the back-and-forth direction in the drawing) along the rails 110*a* and 110*b* provided on the side plates 109*a* and 109*b*. Furthermore, although not illustrated herein, the horizontal clamp-moving member 108*a* is inserted into the vertical clamp-moving member 107*a* on the right side of FIG. 2, and a second clamp stay shaft (not illustrated) is inserted into the horizontal clamp-moving member 108*a*.

In the clamp stay 114, an upper clamp 120*b* is pressed against a lower clamp 121*b*, that is a fixed member, by a spring 122*b* with a clamp shaft 123 serving as an axis of rotation with respect to the lower clamp 121*b*. Although not illustrated in the drawing, also on the right side, an upper clamp 120*a* is pressed against a lower clamp 121*a*, that is a fixed member, by a spring 122*a* with the clamp shaft 123 serving as an axis of rotation with respect to the lower clamp 121*a*. In the meantime, the members not illustrated in the drawings are also denoted with suffixes "a" and "b" so as to clarify the correspondence therebetween. At this time, the suffix "a" is used to indicate the members illustrated on the right side in FIG. 2, and the suffix "b" is used to indicate the members illustrated on the left side in FIG. 2.

Figure 4:
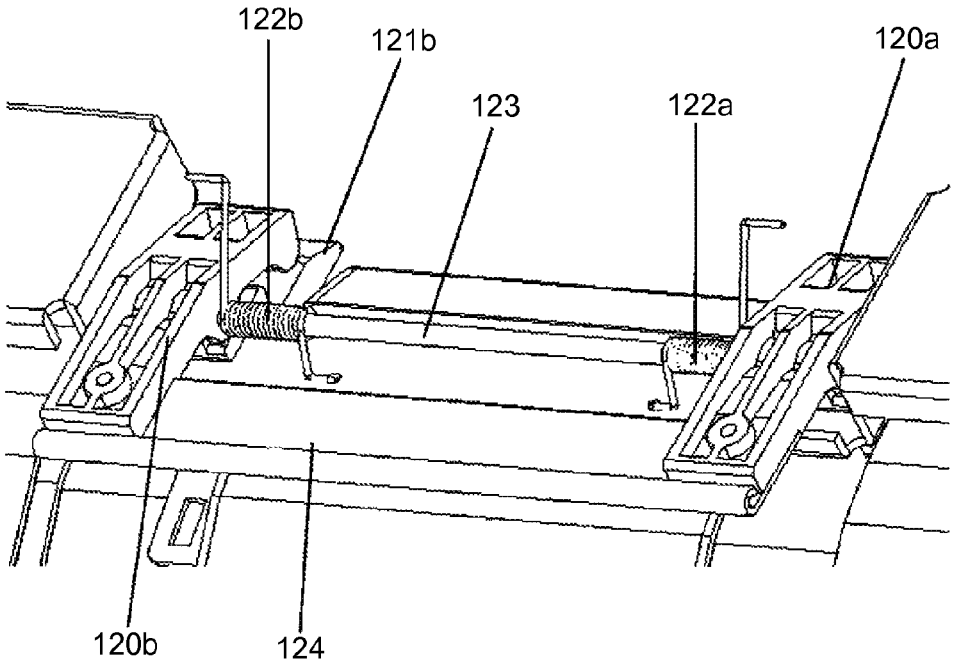
FIG. 4 is an enlarged view illustrating a portion R that corresponds to the portion enclosed by the dotted line in FIG. 3 and the upper portion of the conveying guide plate in FIG. 2.

FIG. 4 is an enlarged view illustrating a portion R that corresponds to the upper portion of the conveying guide plate 113 in FIG. 2 and a portion enclosed by the dotted line in FIG. 3. Furthermore, the portion illustrated in FIG. 4 is a clamp portion that grips the trailing end of the sheet bundle PB. FIG.

5 is a perspective view of a main part illustrating a state where the trailing end of the sheet bundle PB is gripped in the clamp portion illustrated in FIG. 4.

Figure 5:
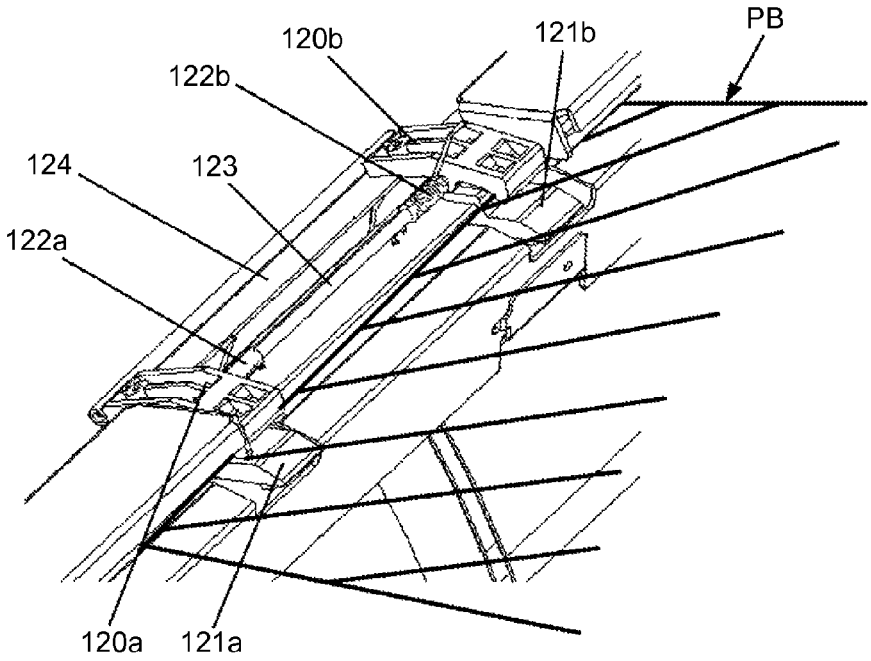
FIG. 5 is a perspective view of a main part illustrating a state where a trailing end of a sheet or a sheet bundle PB is gripped in a clamp portion illustrated in FIG. 4.

In FIGS. 4 and 5, the clamp portion of the clamp bundle-conveying unit 100-1 is connected to the upper clamps 120*a* and 120*b*, the lower clamps 121*a* and 121*b* are connected to the clamp shaft 123, and the upper clamps 120*a* and 120*b* are connected to each other by a clamp-portion-connecting sheet-metal member 124. Accordingly, the upper clamps 120*a* and 120*b* of the left and right clamp portions are configured to be capable of performing a simultaneous operation. The lower clamps 121*a* and 121*b* and the upper clamps 120*a* and 120*b* grip the trailing end of the sheet or the sheet bundle PB through elastic force of the springs 122*a* and 122*b* that urge the respective pairs of the opposing upper and lower clamps.

Figure 6:
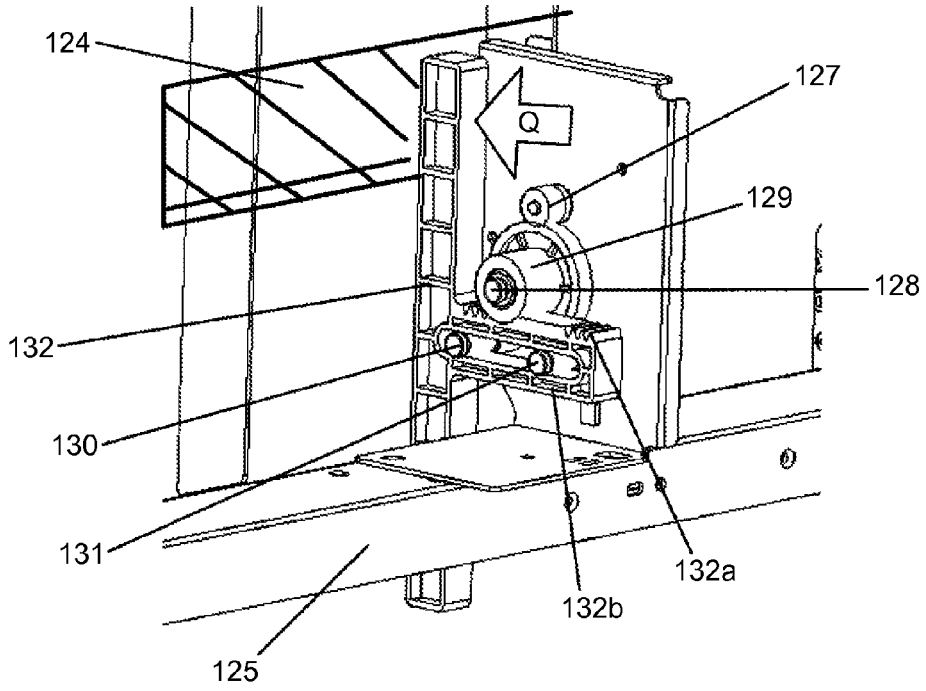
FIG. 6 is an enlarged view illustrating a portion V enclosed by one the dotted lines in FIG. 2 and is a perspective view illustrating a clamp-releasing mechanism used for releasing a clamping operation using a spring of the clamp portion that nips the trailing end of the sheet bundle.
Figure 7:
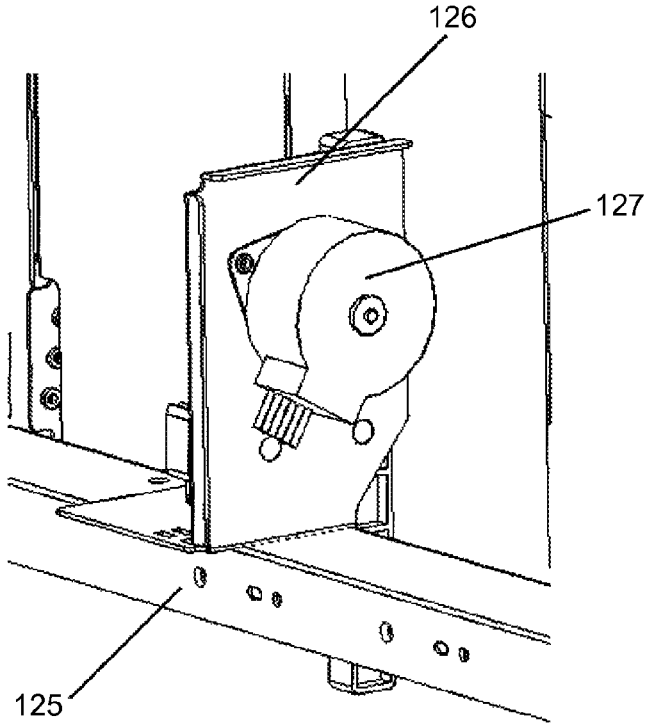
FIG. 7 is a perspective view of the main part when

FIGS. 6 and 7 are enlarged views illustrating a portion V enclosed by one of the dotted lines in FIG. 2. FIG. 6 is a perspective view illustrating a clamp-releasing mechanism used for releasing the clamping operation with the springs 122*a* and 122*b* of the clamp portion nipping the trailing end of the sheet bundle PB, and FIG. 7 is a perspective view of a main part in FIG. 6 viewed from the opposite side. In these drawings, the clamp-releasing mechanism includes a clamp-releasing motor 127 and a clamping-pressure releasing lever 132. The clamp-releasing motor 127 is attached to a clamp-releasing motor bracket 126 fixed to a stay 125 and is driven by the clamp-releasing motor 127.

The driving force generated from the clamp-releasing motor 127 is transmitted, through a gear 129 with a shaft 128 serving as a rotating shaft, to a rack portion 132*a* of the clamping-pressure releasing lever 132 for which shafts 130 and 131 serve as support shafts in the transverse direction. The clamping-pressure releasing lever 132 is provided at an end on the sheet-conveying side of a support member 132*b* on which the rack portion 132*a* is provided such that the clamping-pressure releasing lever 132 is to be parallel to the sheet conveying direction. Accordingly, the clamping-pressure releasing lever 132 moves in the direction indicated by arrow Q. When the clamp-portion-connecting sheet-metal member 124 illustrated in FIGS. 4 and 5 is pressed, the movable upper clamps 120*a* and 120*b* are opened with respect to the sheet bundle PB, so that the sheet bundle PB is unclamped. Accordingly, the clamping of the sheet bundle PB is released during the folding process after the sheet bundle PB is conveyed, so that press-folding can be performed on the sheet bundle PB.

Figure 8:
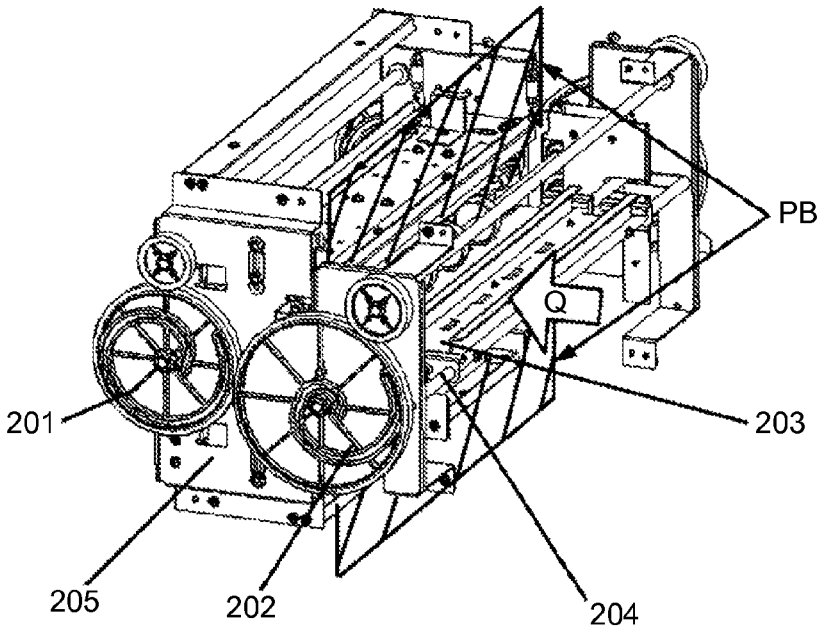
FIG. 8 is a perspective view illustrating a press-folding unit.
Figure 9:
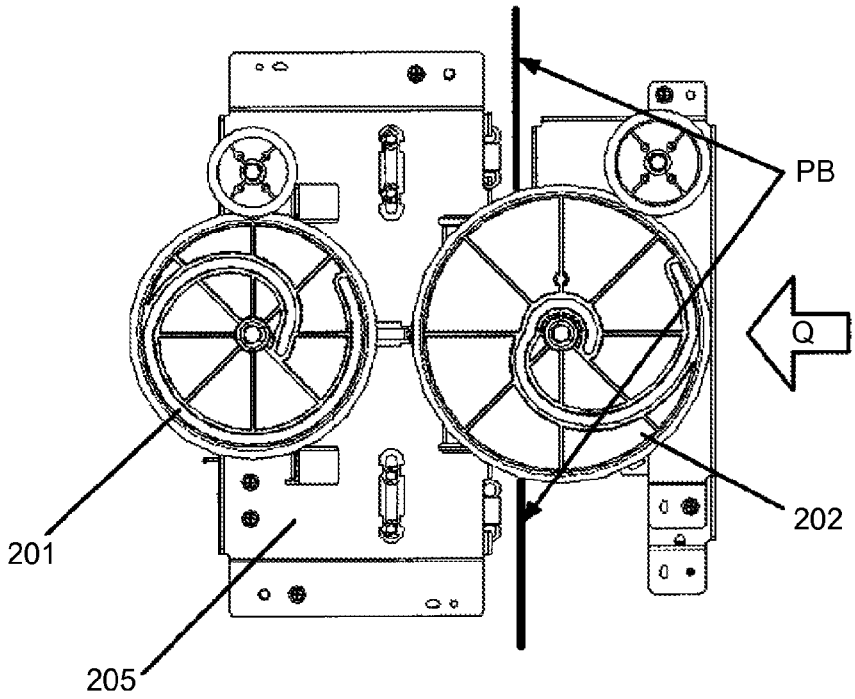
FIG. 9 is a front view illustrating the press-folding unit viewed from a front side of the apparatus.

FIG. 8 is a perspective view illustrating the press-folding unit, and FIG. 9 is a front view when the press-folding unit is viewed from the front side of the apparatus. The press-folding unit 200 is provided in the center-folding unit 119, and includes a pressing-plate driving cam 201, a folding-blade driving cam 202, the folding blade 203, a folding-blade supporting bar 204, and front and rear side plates 205. When the folding-blade driving cam 202 rotates, the folding blade supporting bar 204 moves horizontally along a horizontal groove 205*a* (see FIG. 11) and the folding blade 203 moves in the direction indicated by the arrow Q due to the relation between the rotation of a cam groove 202*a*, into which the folding blade supporting bar 204 is loosely fitted, and the horizontal groove 205*a* of the side plate 205. Accordingly, the center portion of the sheet bundle PB in the length direction is guided to the press-folding unit 200.

Figure 10:
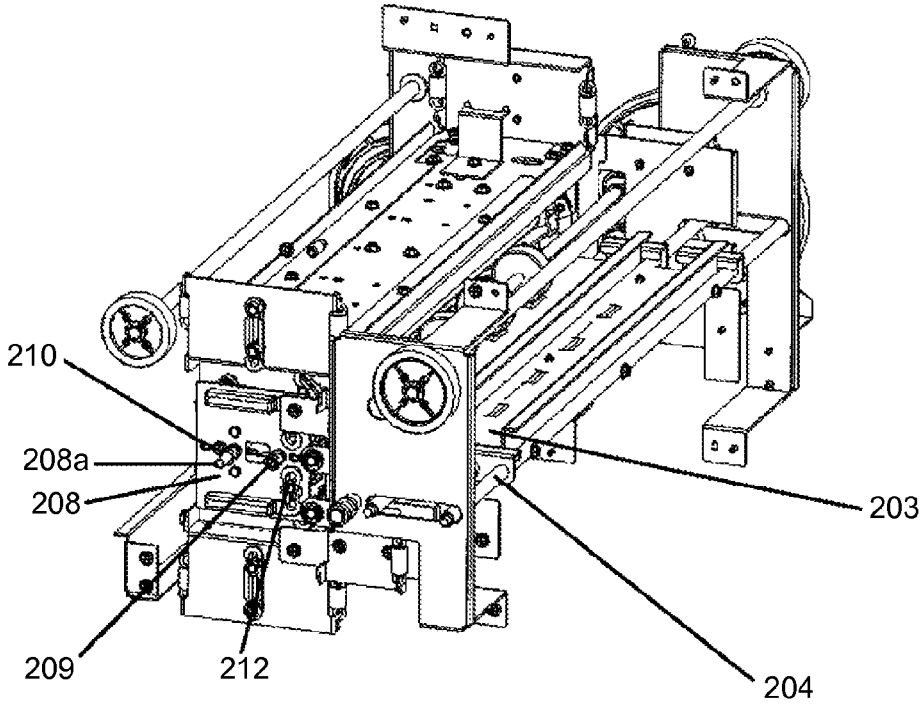
FIG. 10 is a perspective view illustrating a state where a pressing plate driving cam, a folding blade driving cam, and a side plate are removed from the state in FIG. 8.
Figure 11:
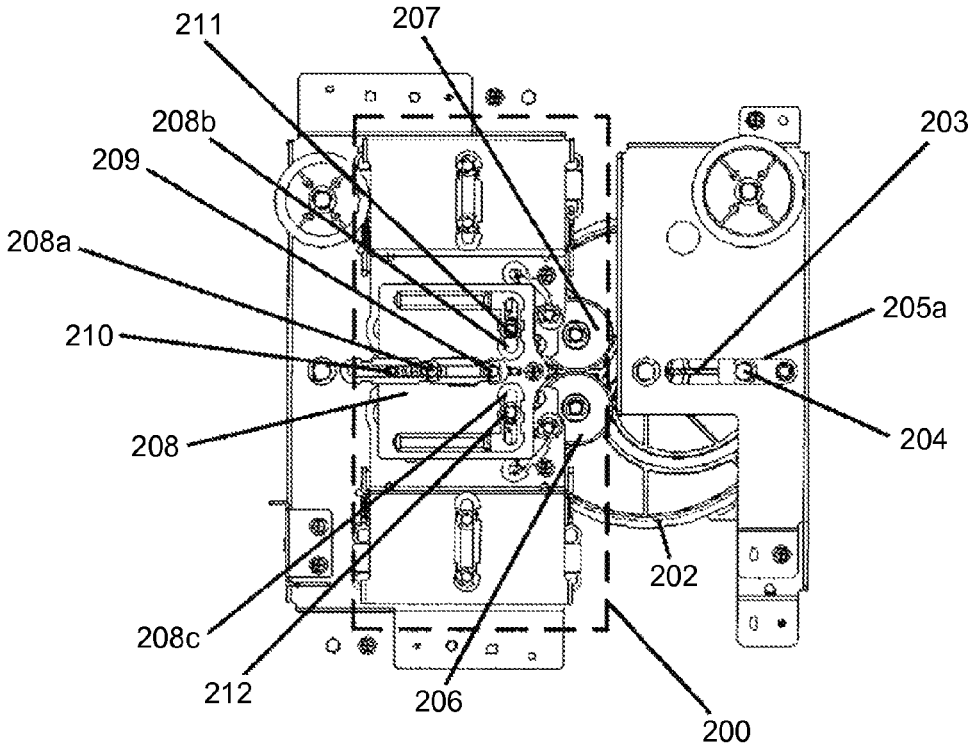
FIG. 11 is a front view of the apparatus illustrated in FIG. 10 viewed from the front side.

FIG. 10 is a diagram illustrating a state where the pressing-plate driving cam 201, the folding-blade driving cam 202, and the side plate 205 in FIG. 8 are removed, and FIG. 11 is a front view of the apparatus illustrated in FIG. 10 viewed from the front side.

In these drawings, the press-folding unit 200 includes the conveying rollers 206 and 207, a moving plate 208, press-guiding rollers 211 and 212, and press-releasing cams 209 and 210. In the sheet bundle PB or the sheet guided to the press-folding unit 200 by the folding blade 203, the sheet bundle PB or the sheet is conveyed by the conveying rollers 206 and 207 until the leading end P1 of the folding portion thereof reaches the press-folding unit 200. When the moving plate 208 moves, the press-guiding rollers 211 and 212 and the press-releasing cams 209 and 210 connected to the moving plate 208 move in a reciprocating manner in the sheet conveying direction (the direction indicated by the arrow Q). The moving plate 208 is driven in the horizontal direction by a pin 208*a* that is loosely fitted into the pressing-plate driving cam 201.

That is, the pin 208*a* provided in the moving plate 208 illustrated in FIG. 10 is loosely fitted into a cam groove 201*a*, having a spiral shape, of the pressing-plate driving cam 201 at an inner side of the moving plate 208 in the drawing, functions as a cam follower with respect to the cam groove 201*a* in accordance with the rotation of the pressing-plate driving cam 201, and moves in the horizontal direction. Accordingly, the moving plate 208 moves in a reciprocating manner in the direction indicated by the arrow Q and the reverse direction thereof along the same trajectory as the trajectory of the pin 208*a*.

On the other hand, the press-releasing cams 209 and 210 are fixed to the moving plate 208, and move together with the movement of the moving plate 208. On the other hand, as illustrated in FIG. 11, shaft ends of the press-guiding rollers 211 and 212 are also loosely fitted into grooves 208*b* and 208*c* of the moving plate 208. In association with the movement of the moving plate 208 in the direction indicated by the arrow Q, the press-guiding rollers 211 and 212 move in the same direction on the pressing plates 219 and 220, so that a nip between the pressing plates 219 and 220 is moved, as described later with reference to FIG. 16, and the leading end P1 of the folding portion of the sheet bundle PB or the sheet is folded.

Figure 12:
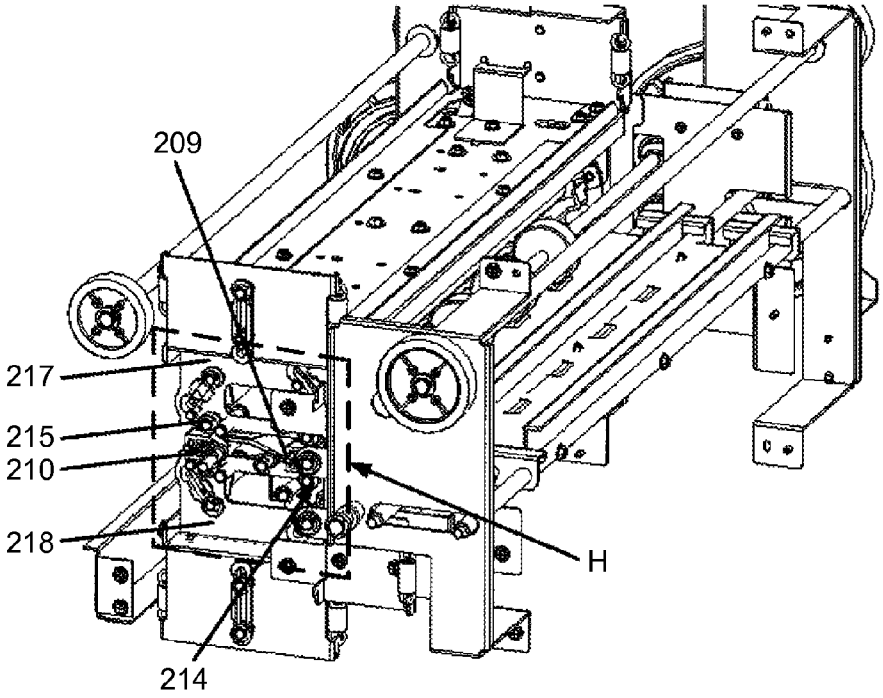
FIG. 12 is a perspective view illustrating a state where a moving plate is removed from the state in FIG. 10.
Figure 13:
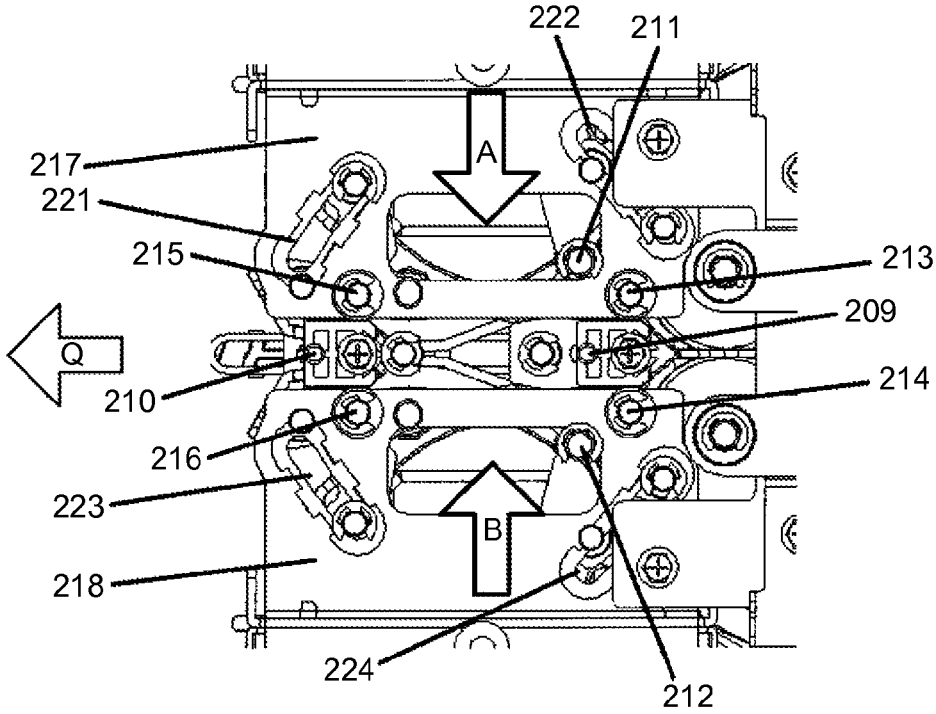
FIG. 13 is a front view illustrating an enlarged portion H enclosed by the dotted line in FIG. 12 as seen from the front side of the apparatus.

FIG. 12 is a perspective view illustrating a state where the moving plate 208 is removed from FIG. 10, and FIG. 13 is an enlarged front view illustrating the portion H enclosed by the dotted line in FIG. 12, viewed from the front side of the apparatus.

In FIGS. 12 and 13, an upper pressing unit 217 and a lower pressing unit 218 provided above and below a sheet conveying path, respectively, are in a state to apply pressure to each other through springs provided at four corners on each of the front side and the rear side of the upper pressing unit 217 and the lower pressing unit 218. In a standby state, the upper pressing unit 217 and the lower pressing unit 218 are separated from each other by the press-releasing cams 209 and 210 provided inside the moving plate 208, corresponding to a state where the leading end P1 of the folding portion of the sheet bundle PB or the sheet is received.

When the moving plate 208 moves in the direction indicated by the arrow Q, the press-releasing cams 209 and 210 attached to the moving plate 208 move, pressure-releasing rollers 213 and 215 of the upper pressing unit 217 and pressure-releasing rollers 214 and 216 of the lower pressing unit 218 move in the directions indicated by arrows A and B through slopes of the press-releasing cams 209 and 210, thereby the leading end P1 of the folding portion of the sheet bundle PB or the sheet is pressed.

Figure 14:
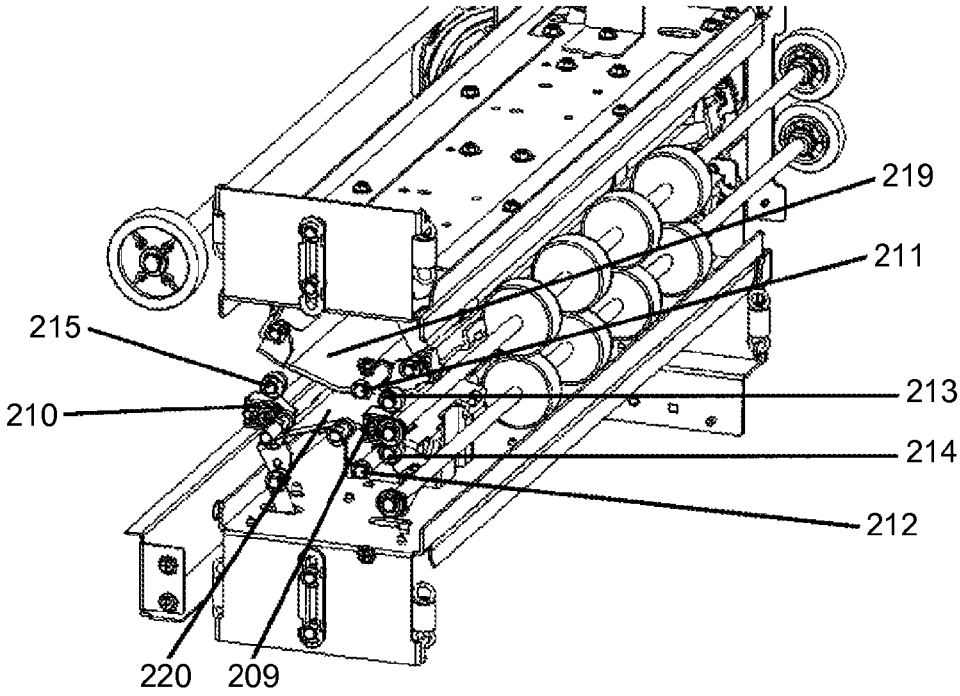
FIG. 14 is a perspective view illustrating an inside of a pressing unit in FIG. 10.
Figure 15:
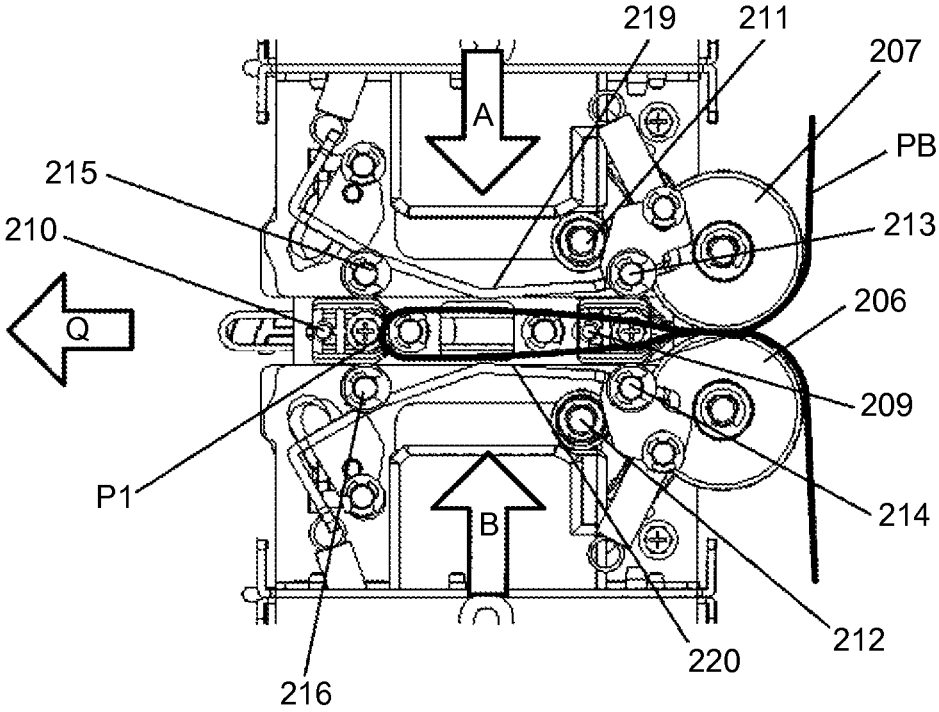
FIG. 15 is a front view of FIG. 14 as seen from the front side of the apparatus.

FIG. 14 is a diagram illustrating inside of the pressing unit in FIG. 10, and FIG. 15 is a front view when FIG. 14 is seen from the front side of the apparatus.

In FIGS. 14 and 15, the upper pressing plate 219 and the lower pressing plate 220 are provided in the upper pressing unit 217 and the lower pressing unit 218 of the pressing unit, respectively. When the press-releasing cams 209 and 210 move, the upper pressing plate 219 moves in the direction indicated by the arrow A and the lower pressing plate 220 moves in the direction indicated by the arrow B along with the movement of the upper and lower pressing units 217 and 218. According to this movement, the sheet bundle PB is nipped between the upper and lower pressing plates 219 and 220, and is folded.

The press-guiding rollers 211 and 212 connected to the moving plate 208 move on the upper and lower pressing plates 219 and 220 along with the movement of the moving plate 208 in the direction indicated by the arrow Q. According to this movement, the leading end P1 of the folding portion of the sheet bundle PB or the sheet is folded by the curved shapes of the upper and lower pressing plates 219 and 220 that are movable and rotatable along grooves 221, 222, 223, and 224 (see FIG. 13) formed on side surfaces of the upper and lower pressing units 217 and 218.

Figure 16:
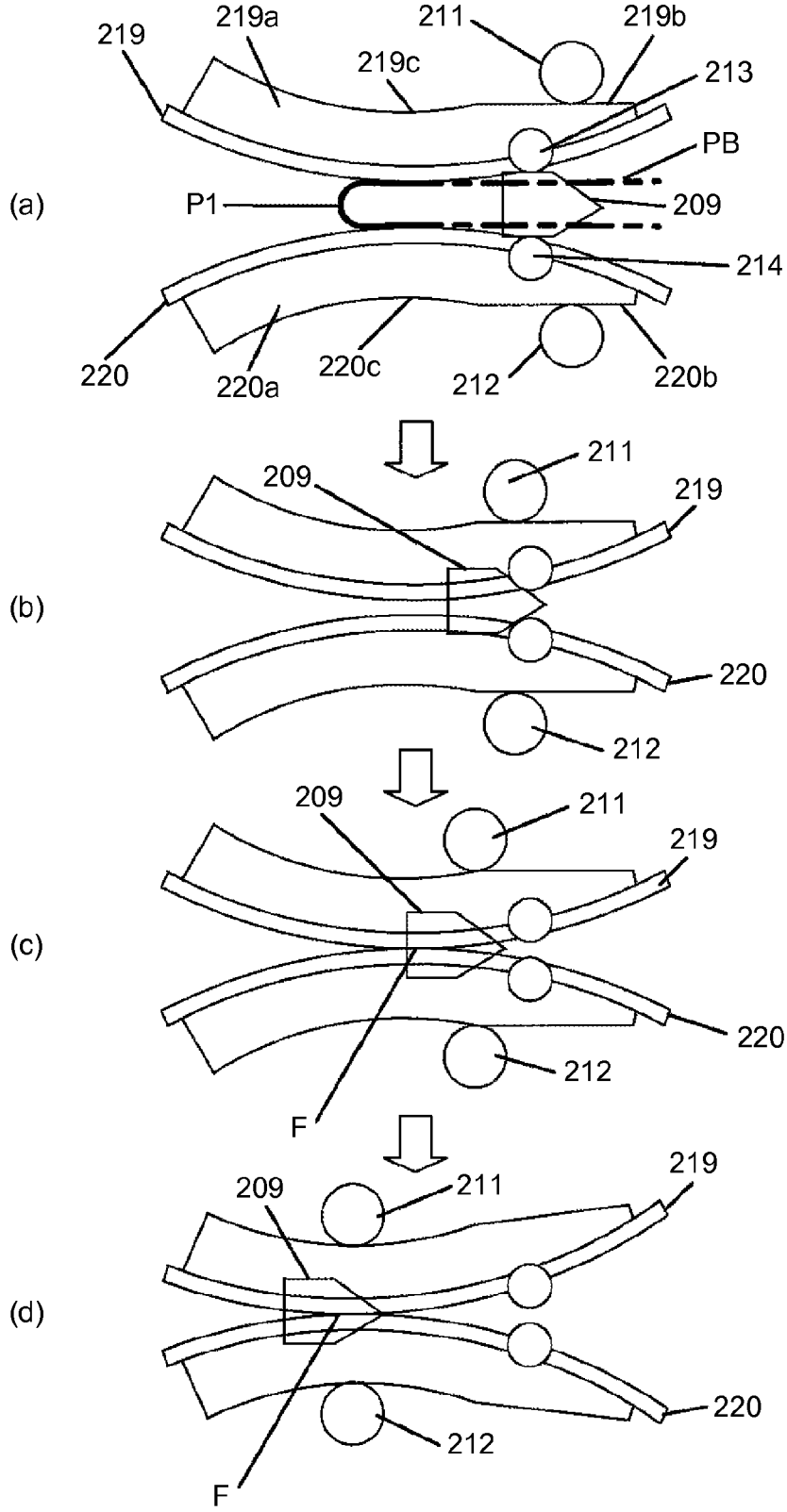
FIG. 16 is an explanatory diagram illustrating a press operation for performing folding on a sheet bundle.

FIG. 16 is an explanatory diagram illustrating a press operation for performing folding on the sheet bundle PB or the sheet. In FIG. 16, (*a*) illustrates a press standby state, (*b*) illustrates a state in which the pressing unit is in an approaching operation, (*c*) illustrates a pressing state, and (*d*) illustrates a state in which a crease forming operation is performed.

In the press standby state of FIG. 16(*a*), the press-releasing cams 209 and 210 are inserted into the pressure-releasing rollers 213 and 215 (where the rollers are the same elements as those illustrated in FIGS. 13 and 15 and the downstream element denoted by the larger reference numeral is not illustrated in FIG. 16; however, because both elements function similarly to each other, both reference numerals are used together in the following description) of the upper pressing unit 217 and the pressure-releasing rollers 214 and 216 of the lower pressing unit 218. The sheet bundle PB (enclosed by the dashed-dotted line), having been conveyed to the press-folding unit 200 by the folding blade 203 and the conveying rollers 206 and 207, is placed therebetween. The sheet bundle PB is not illustrated in FIGS. 16(*b*) to 16(*d*).

The movement of the moving plate 208 causes the press-releasing cams 209 and 210 and the press-guiding rollers 211 and 212 to move in the left direction (the direction indicated by the arrow Q of FIG. 15) from the state in FIG. 16(*a*).

When the press-releasing cams 209 and 210 move away from the pressure-releasing rollers 213 and 215 of the upper pressing unit 217 and the pressure-releasing rollers 214 and 216 of the lower pressing unit 218, the upper and lower pressing units 217 and 218 move closer to each other as illustrated in FIG. 16(*b*).

When the press-releasing cams 209 and 210 are completely separated away from the pressure-releasing rollers 213, 215, 214, and 216, as illustrated in FIG. 16(*c*), the upper and lower pressing plates 219 and 220 come into close contact with each other, and a pressing pressure is applied to the sheet bundle between the pressing plate 219 and the pressing plate 220 in the vertical direction.

Because only the vertical load is applied from the press-guiding rollers 211 and 212 to the upper and lower pressing plates 219 and 220 until reaching the state in FIG. 16(*c*) due to the presence of horizontal portions 219*b* and 220*b* of guide members 219*a* and 220*a* of the upper and lower pressing plates 219 and 220, the postures of the pressing plates 219 and 220 do not change.

Furthermore, when the moving plate 208 moves, as illustrated in FIG. 16(*d*), because curved surfaces of the upper and lower pressing plates 219 and 220 and rolling surfaces 219*c* and 220*c* of the press-guiding rollers 211 and 212 of the guide members 219*a* and 220*a* have an identical curvature to each other, by the rolling of the press-guiding rollers 211 and 212, the upper and lower pressing plates 219 and 220 undergo rotational motions, and fold the sheet bundle toward the leading end of the folding portion at the contact portion between the upper and lower pressing plates 219 and 220. Through these steps, the leading end of the folding portion of the sheet bundle is folded.

That is, in the standby state, the upper pressing unit 217 and the lower pressing unit 218 are separated from each other by the press-releasing cams 209 and 210 provided inside the press-moving plate 208, so that the leading end of the folding portion of the sheet bundle can be received. When the moving plate 208 moves in the direction indicated by the arrow Q in FIG. 15, the press-releasing cams 209 and 210 connected to the moving plate 208 move in the same direction, and the pressure-releasing rollers 213 and 215 of the upper pressing unit 217 and the pressure-releasing rollers 214 and 216 of the lower pressing unit 218 are caused to move in the directions indicated by the arrows A and B (see FIGS. 13 and 15) by the slopes of the press-releasing cams 209 and 210, and a press operation proceeds to reach the leading end P1 of the folding portion of the sheet bundle PB or the sheet.

Figure 17:
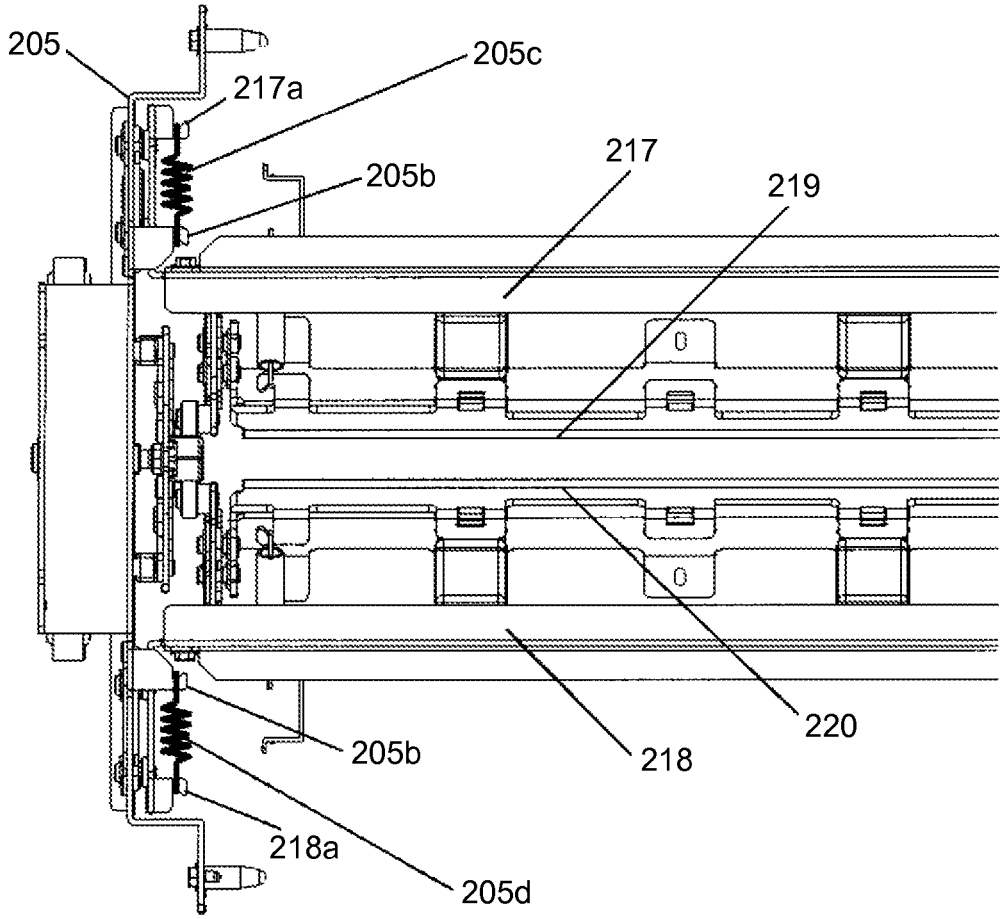
FIG. 17 is a front view illustrating a main part of a mechanism that generates pressure between an upper pressing unit and a lower pressing unit.

FIG. 17 is a diagram illustrating a mechanism that generates pressure between the upper pressing unit and the lower pressing unit. In the drawing, the upper pressing unit 217 and the lower pressing unit 218 are in a state to apply pressure to each other through springs provided at four corners on each of the front side and the rear side of the upper pressing unit 217 and the lower pressing unit 218, as mentioned above with reference to FIGS. 12 and 13. The pressing mechanism includes a hook 205*b* integrated with the side plate 205 and hooks 217*a* and 218*a* that are integrated with the upper pressing unit 217 and the lower pressing unit 218, respectively. The upper pressing unit 217 is in a state in which the hook 205*b* of the side plate 205 and the hook 217*a* of the upper pressing unit 217 are pulled by a pressing spring 205*c*, so that the upper pressing unit 217 is elastically pressed downward (toward the lower pressing unit 218). The lower pressing unit 218 is in a state in which the hook 205*b* of the side plate 205 and the hook 218*a* of the lower pressing unit 218 are pulled by a pressing spring 205*d*, so that the lower pressing unit 218 is elastically pressed upward (toward the upper pressing unit 217). In this way, the pressing springs 205*c* and 205*d* are used to press the pressing plate 219 of the upper pressing unit 217 and the pressing plate 220 of the lower pressing unit 218, respectively. In the embodiment, because four corners on each of the front side and the rear side of the upper pressing unit 217 and the lower pressing unit 218 are pressed by the springs, the four pressing springs 205*c* are provided at the four corners of the upper pressing unit 217 and the four pressing springs 205*d* are provided at the four corners of the lower pressing unit 218, so that a total of the eight (=4×2) pressing springs are used for pressing the corners of the upper and lower pressing units 217 and 218.

Figure 18:
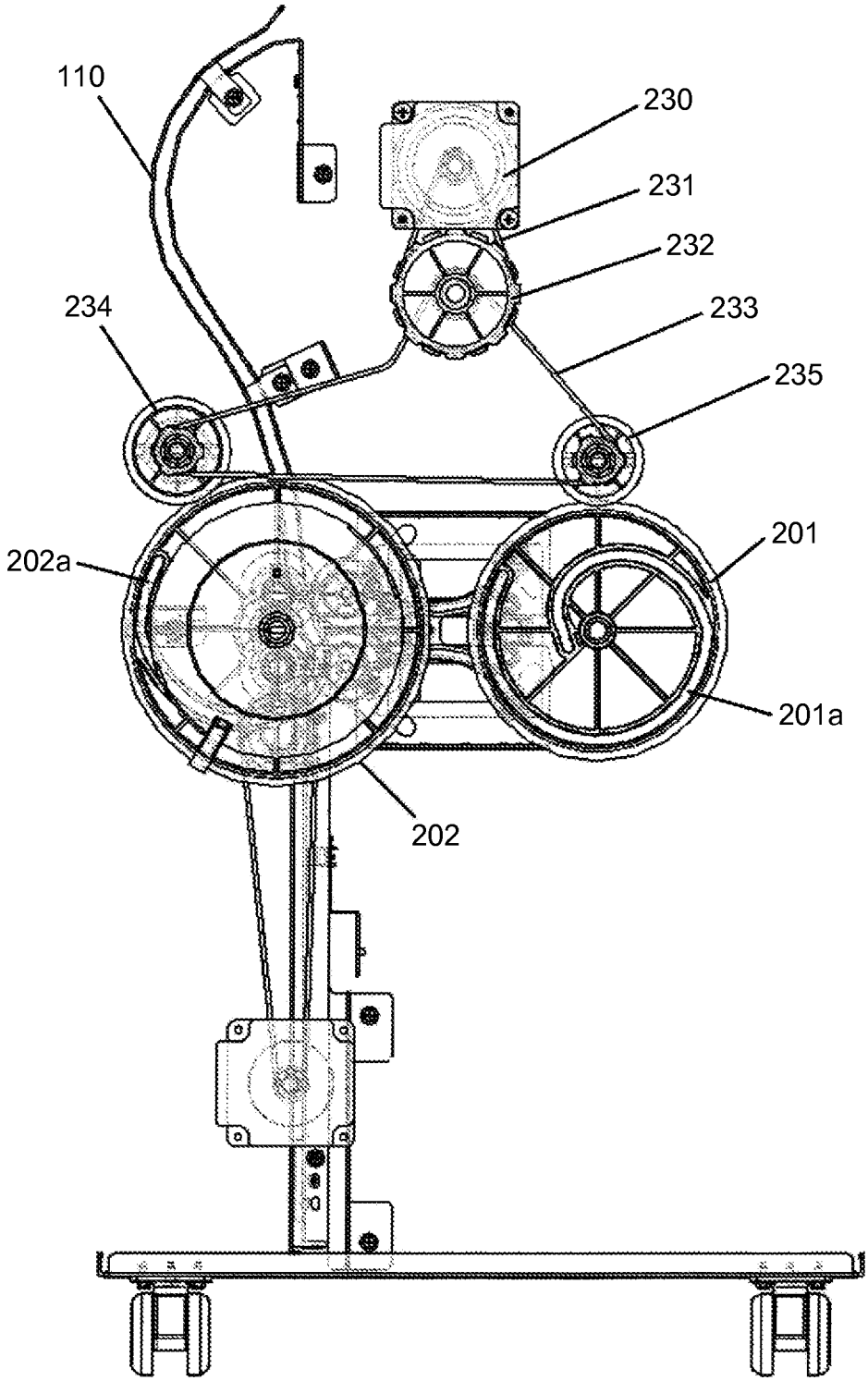
FIG. 18 is an explanatory diagram illustrating a driving mechanism of the pressing plate driving cam and the folding blade driving cam.

FIG. 18 is the explanatory diagram illustrating the driving mechanism of the pressing-plate driving cam 201 and the folding-blade driving cam 202. The driving mechanism of the pressing-plate driving cam 201 and the folding-blade driving cam 202 illustrated in FIGS. 8 and 9 includes a fold-driving motor 230, a fold-driving-motor timing belt 231, a fold-driving pulley 232, a fold-driving-portion timing belt 233, a folding-blade driving gear 234, and a pressing-plate driving gear 235.

In the driving mechanism including the above elements, when the fold-driving motor 230 rotates, the driving force of rotating shaft of the fold-driving motor 230 is transmitted to the fold-driving-motor timing belt 231 through a pulley, and is further transmitted from the fold-driving pulley 232 to the fold-driving-portion timing belt 233. Accordingly, the folding-blade driving gear 234 rotationally drives the folding-blade driving cam 202, and the pressing-plate driving gear 235 rotationally drives the pressing-plate driving cam 201. Because the folding-blade driving gear 234 and the pressing-plate driving gear 235 are driven by being engaged with the same fold-driving-portion timing belt 233, both are certainly driven in a synchronized manner.

The folding blade 203 illustrated in FIG. 11 is configured to be integrated with the folding-blade supporting bar 204 such that the movement of the folding-blade supporting bar 204 along the spiral-shaped cam groove 202*a* of the folding-blade driving cam 202 causes the folding blade 203 to move horizontally along an elongated groove 202*c* provided in a stay 202*b* of the folding-blade driving cam 202 (see FIG. 11). That is, both ends of the folding-blade supporting bar 204 are loosely fitted into the spiral-shaped cam groove 202*a* of the folding-blade driving cam 202, and the folding blade 203 is allowed to move only along the horizontal groove 205*a* with respect to the sheet. Therefore, the rotation of the folding-blade driving cam 202 is converted into the linear reciprocating movement of the folding blade 203.

Figure 19A:
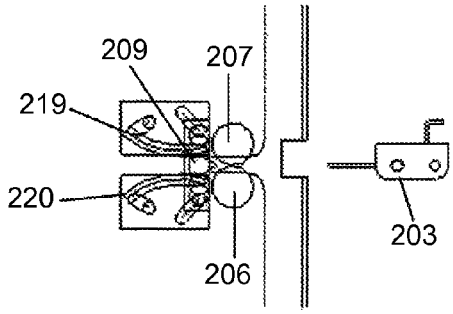
FIGS. 19A to 19D are explanatory diagrams illustrating operations of the folding blade driving cam and the pressing plate driving cam and operations of a folding blade moving together with the folding blade driving cam and a pressing-pressure releasing member moving together with the pressing plate driving cam.

FIGS. 19A to 19D are the explanatory diagrams illustrating the operations of the fold-driving motor 230 viewed from an opposite side to FIG. 18 as illustrated in FIG. 19A, showing the operations of the folding-blade driving cam 202 and the pressing-plate driving cam 201, the operations of the folding blade 203 that moves together with the folding-blade driving cam 202, and the operations of the pressing-pressure releasing cam 209 that is attached to the moving plate 208 and that moves together with the pressing-plate driving cam 201 when the fold-driving motor 230 rotates in such a manner that the shaft of the fold-driving motor 230 in FIG. 18 is rotated in the counter-clockwise direction.

Figure 19B:
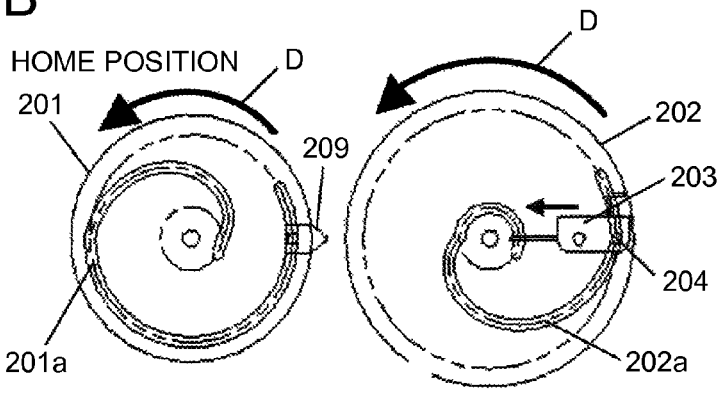
Figure 19C:
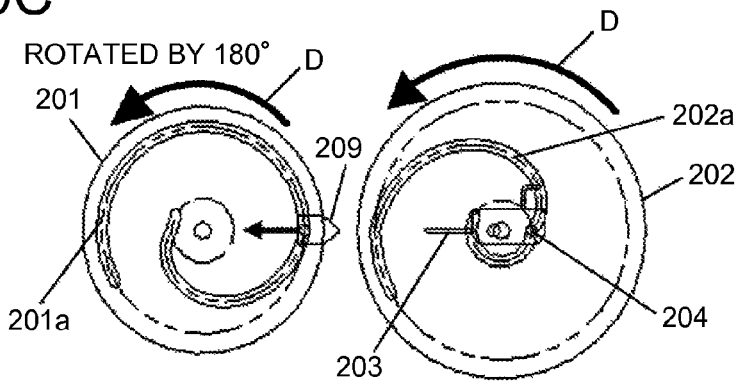
Figure 19D:
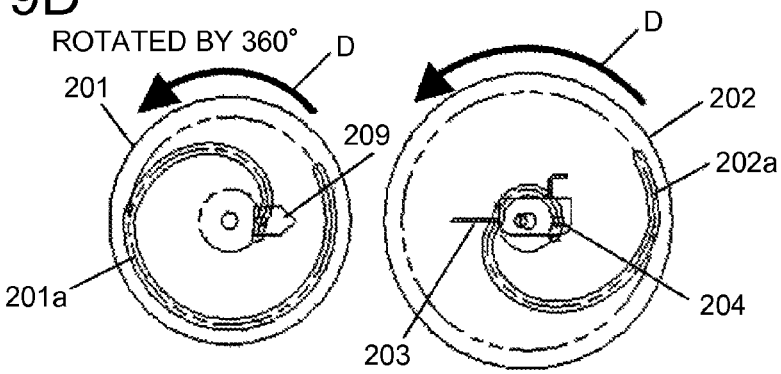

When the fold-driving motor 230 is rotated in the clockwise direction (in the counter-clockwise direction in FIG. 18) from the home position illustrated in FIG. 19B as viewed along the shaft of the fold-driving motor 230, the folding-blade driving cam 202 and the pressing plate driving cam 201 rotate simultaneously in the counter-clockwise direction (the direction indicated by arrow D) in FIGS. 19A to 19D. However, the folding blade 203 moves to the left in the horizontal direction in the drawing along the spiral-shaped cam groove 202*a* of the folding-blade driving cam 202 while the rotation angle of the folding-blade driving cam 202 rotates increases from 0° to 180° as illustrated in FIG. 19C, and the pressing-pressure releasing cam 209 (the moving plate 208) moves to the left in the drawing while the folding-blade driving cam 202 rotates from 180° to 360° as illustrated in FIG. 19D.

In this way, in the embodiment, the folding blade 203 and the pressing-plate driving cam 201 are operated at different timing by the folding-blade driving cam 202 and the spiral-shaped cam groove 202*a*. The sheet or the sheet bundle is first guided to the folding unit by the folding blade 203, the pressing-plate driving cam 201 is moved to press the pressing plates 219 and 220, thereby the folding operation is performed in a pressed state as illustrated in FIG. 16(*a*) or 16(*d*).

After the folding operation is completed, when the fold-driving motor 230 is rotated in the reverse direction, the pressing-pressure releasing cam 209 first moves while the cam rotates from 0°, as in FIG. 19D, to 180°, as in FIG. 19C, so that the upper pressing unit 217 and the lower pressing unit 218 are opened along the processes illustrated in FIGS. 16(*d*), 16(*c*), 16(*b*), and 16(*a*) in this order. Then, the folding blade 203 moves to the left in the horizontal direction and returns to the home position while the folding-blade driving cam 202 rotates from 180°, as in FIG. 19C, to 360°, as in FIG. 19B.

In this way, in the mechanism illustrated in FIGS. 18 and 19A to 19D, by changing the rotational direction of the fold-driving motor 230, the sheet can be guided to the press-folding unit 200 by the folding blade 203, and the pressing plates 219 and 220 can be operated with shifted pressing timing. Accordingly, a series of operations from the folding operation using the folding blade 203 and the upper and lower pressing plates 219 and 220, the pressure-releasing operation of the upper and lower pressing plates 219 and 220, and retracting operation of the folding blade 203 can be performed through a simple control. At this time, the load operation timing of the folding blade 203 and the load operation timing of the upper and lower pressing plates 219 and 220 are shifted from each other so as to prevent a large driving load from occurring on the fold-driving motor 230. Accordingly, a small, low output, and inexpensive motor may be used for the fold-driving motor 230, and the driving mechanism that includes the fold-driving motor 230 cam be made small and space-saving.

The pressing-releasing mechanism of the upper and lower pressing plates 219 and 220 has been described as above. In the embodiment, the folding operation is performed by moving the pressing position (the contact position) between the upper and lower pressing plates 219 and 220 as described with reference to FIG. 16. That is, the press-guiding rollers 211 and 212 are moved by the fold driving motor 230 that drives the moving plate 208, and roll on the rolling surfaces 219*c* and 220*c* of the pressing plates 219 and 220, so that the sheet bundle is folded by moving the pressing position between the upper and lower pressing plates 219 and 220 toward the leading end of the folding portion of the sheet bundle. Accordingly, in the embodiment, moving-speed control of the pressing position between the pressing plates 219 and 220 is performed by controlling the driving speed of the fold driving motor 230.

Figure 20:
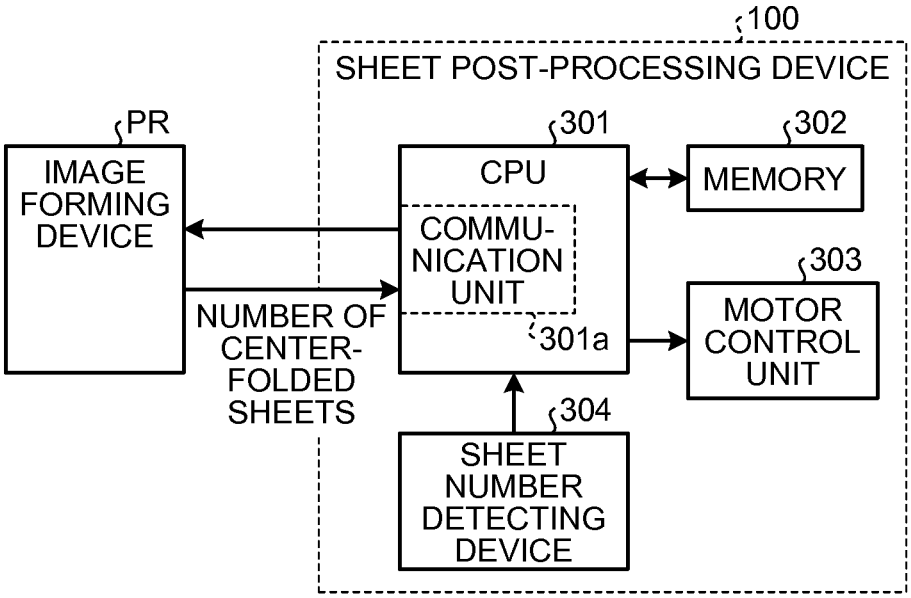
FIG. 20 is a block diagram illustrating a control configuration related to a sheet post-processing device of the embodiment.

The moving speed control is performed, for example, by the control configuration illustrated in FIG. 20. FIG. 20 is a block diagram illustrating the control configuration of the sheet post-processing device 100 according to the embodiment. The control unit of the sheet post-processing device 100 includes a central processing unit (CPU) 301, a memory 302, a motor control unit 303, and a sheet-number detecting device 304. The CPU 301 includes a read-only memory (ROM) and a random access memory (RAM) (not illustrated in the drawing) and also includes a communication unit 301*a*. The CPU 301 loads a computer program stored in the ROM into the RAM, and executes a control processing defined in the computer program by using the RAM as a work area and a data buffer. In the meantime, the memory 302 may be used as the RAM as well.

The motor control unit 303 is instructed by the CPU 301 to control the driving of the fold driving motor 230. Here, the driving control includes ON/OFF control, normal/reverse rotation control, and speed control. The CPU 301 controls, based on sheet information such as the number of sheets, the thickness of the sheet, and the size of the sheet, the rotation speed of the fold driving motor 230, changes the moving speed of the pressing position F between the upper and lower pressing plates 219 and 220, and shortens processing time consumed by an unnecessary folding process. That is, in the case where the number of sheets is large, the sheet thickness is large, and the sheet size is large, an integral value of the pressure used for folding the sheet bundle needs to be made large with respect to the sheet bundle; however, in other cases, the integral value may be made small. Therefore, when the moving speed of the pressing position F is controlled based on the information such as the number of sheets, the thickness of the sheet, and the size of the sheet, as described above, the productivity of the folding process may be improved without causing degradation in the folding quality (the folding height).

At this time, the sheet number detecting device 304 may detect the number of sheets on the basis of the number of conveyed sheets counted by the entrance sensor 13. Or, the number of sheets, the thickness of the sheet, the size of the sheet, and the like may be received as sheet information from the image forming device PR. Then, the CPU 301 processes the sheet information and instructs the rotation speed of the fold driving motor 230 to the motor control unit 303. Accordingly the pressing position moving speed is controlled. That is, in the motor control unit 303, the driving of the fold driving motor 230 is controlled at the speed instructed by the CPU 301 on the basis of the sheet information received from the sheet number detecting device 304 or the image forming device PR, and the folding process is performed. For example, in the case where there are a small number of sheets, the folding height may be lowered even when the sheet pressing time is short. However, in the case where the number of sheets of the sheet bundle increases, the folding height may be made low when the press-moving speeds of the upper and lower pressing plates 219 and 220 are made slow, thereby changing the driving speed of the fold driving motor 230 according to the number of sheets to be folded.

In this way, processing time consumed by an unnecessary folding process may be reduced without causing degradation in the folding quality by changing the pressing-position moving speeds of the upper and lower pressing plates 219 and 220 according to the number of sheets within a speed condition to keep the height quality of the crease.

Furthermore, the control unit may be able to change the pressing plate press-moving speed between the folding operation and other operations. That is, in the case where the upper and lower pressing plates 219 and 220 are returned to the home position after the folding operation has been performed or the turning operation is performed at the initial operation timing, the fold driving motor 230 is driven at a high speed. Accordingly, the folding process time may be reduced and the productivity of the folding process may be improved without degrading the folding quality (the folding height).

When the folding process is performed on the sheet bundle, the pressing plate press-moving speed and the applied pressure become important. When the pressing plate pressing position F moves toward the crease (the leading end P1 of the folding portion) of the sheet bundle PB, for example, control may be performed to drive the fold driving motor 230 at a high speed up before reaching the leading end P1 of the folding portion, and the fold driving motor 230 is decelerated when the pressing plate pressing position F is near the leading end P1 of the folding portion, and the folding operation may be performed at a low speed. Accordingly, the folding process time may be reduced and the productivity of the folding process may be improved without degrading the folding quality (the folding height).

Specifically, what is important in the control of the pressing plate press-moving speed during the folding process is the pressing plate press-moving speed of the crease (the leading end P1 of the folding portion), and the folding height may be lowered as the pressing plate press-moving speed becomes slower. Therefore, in a series of operations to move the pressing plate pressing position F toward the leading end P1 of the folding portion during the folding process of the sheet bundle PB, the rotation speed of the fold driving motor 230 is driven at an appropriate speed depending on the pressing position of the upper and lower pressing plates 219 and 220 with respect to the sheet bundle PB to be folded. The driving control is performed by the motor control unit 303 on the basis of the instruction by the CPU 301.

In this control, for example, driving pulses of the fold-driving motor 230 are counted, the fold-driving motor 230 is driven at a high speed before the pressing plate pressing position F comes close to the leading end P1 of the folding portion, the fold driving motor 230 is decelerated when the pressing plate pressing position F comes close to the leading end P1 of the folding portion, and the fold driving motor 230 continues a low-speed driving until the completion of the conveying operation with which the leading end of the sheet bundle can certainly pass through the folding process. Alternatively, the driving control causes the press motion of the upper and lower pressing plates 219 and 220 to stop by using the leading end P1 of the folding portion once or a plurality of times. The control is performed by stopping the fold driving motor 230 at the above-described position. Accordingly, the folding process may be performed with high folding quality (a folding height) and the productivity thereof may be improved.

In addition, by performing control with an appropriate combination of the pressing-plate press-moving speed based on the detection output of the sheet number detecting device 304, process time consumed by an unnecessary folding process may be further reduced and the productivity may be improved without causing degradation in the folding quality (the folding height). As the control of such a kind, for example, a control may be exemplified in which the fold-driving motor 230 is driven at a high and constant speed during the folding process when there are a small number of sheets, but the fold-driving motor 230 is decelerated at the leading end P1 of the folding portion of the sheet bundle PB when the number of sheets increases.

Furthermore, sole operation or a combined operations of the speed control and once or a plurality of times of the stop control of the fold driving motor 230 may be performed on the basis of the information on the sheet thickness and the information on the sheet size included in the sheet information. For example, process time consumed by the folding process may be reduced and the productivity may be improved without causing degradation in the folding quality (the folding height) by performing a control in which the fold driving motor 230 is driven at a high and constant speed when the sheet size is small and the sheet thickness is thin and the fold driving motor 230 is decelerated at the leading end P1 of the folding portion when the number of sheets increases or a combination control thereof.

In the meantime, the information on the sheet thickness and the information on the sheet size are transmitted from the image forming device PR to the sheet post-processing device 100, the CPU 301 transmits the motor control information to the motor control unit 303 based on the information, and the motor control unit 303 performs the driving control of the fold-driving motor 230. Specifically, when there is a small size of sheet having a small width, the pressing width of the upper and lower pressing plates 219 and 220 becomes small and thus the pressure concentrates more intensively compared to the case of a large size of sheet having a large width.

Therefore, the pressing-plate pressing position F is moved in a short period of time and at a high speed, and thus the productivity is improved compared to press-folding a large size of sheet. Furthermore, in the case of a sheet in which the sheet thickness is large, a crease is not easily formed on a sheet bundle. Therefore, control is performed to move the pressing position F of the pressing plates 219 and 220 at and in the vicinity of the crease at a low speed for a longer period of time, so that the crease is sufficiently pressed for a sufficiently long time. Accordingly, a high folding quality may be achieved.

Besides the other control of the CPU 301 described above, for example, the CPU 301 performs control (a stop control) in which pressing by the pressing plate is repeated a plurality of times on the basis of the sheet information (in the case of a thick sheet, a large size, large number of sheets, and the like) or the setting by the user. Accordingly, high folding quality using the sheet information or the operation by the user may be achieved.

Furthermore, when the control of pressing by the pressing plates is performed a plurality of times, the fold driving motor 230 may perform the same operation a plurality of times. However, when the pressing plate pressing position F is moved, by being controlled, at different speeds, the process time for the folding process may be reduced and the folding process may be performed with higher folding quality (the higher folding height). This control is realized, for example, in performing the pressing operation using the pressing plates 219 and 220 a plurality of times, by driving the fold driving motor 230 at a low speed at the first time of the folding and the fold driving motor 230 is driven at a high speed at the second time of the folding. Accordingly, the productivity may be improved and high folding quality (the high folding height) may be achieved.

Furthermore, in the embodiment described above, the sheet corresponds to the sheet P, the bundle of sheet members corresponds to the sheet bundle PB, the sheet folding device corresponds to the center-folding unit 119, the press-inserting unit corresponds to the folding blade 203, the pressing plate corresponds to the upper and lower pressing plates 219 and 220, the press driving unit corresponds to the moving plate 208, the pin 208*a*, the folding blade driving cam 202, and the fold driving motor 230, the pressing position moving unit corresponds to the moving plate 208, the pin 208*a*, the folding blade driving cam 202, the press-guiding rollers 211 and 212, and the fold driving motor 230, the control unit corresponds to the CPU 301, the detecting unit that detects the number of sheet members corresponds to the sheet number detecting device 304, and the image forming device corresponds to the image forming device PR.

According to the embodiment, the crease may be formed with high quality using a low-cost mechanism without causing damage such as a wrinkle or a scratch on a sheet member a reduction in the productivity.

In the meantime, the invention is not limited to the above-described embodiment, and may be modified in various forms without departing from the spirit of the invention. All technical issues included in the technical spirit of the claims correspond to the subject of the invention. The above-described embodiment illustrates an appropriate example, but various substitutions, corrections, modifications, or improvements may be made from the content disclosed in the specification by a person skilled in the art, which are included in the scope defined by the appended claims.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet folding device that performs a folding process on one of a sheet member and a bundle of sheet members, the sheet folding device comprising:

a folding unit that folds the one of the sheet member and the bundle of the sheet members;

a pushing unit that is formed like a plate and that abuts on a surface of the one of the sheet member and the bundle of the sheet members so as to push the one of the sheet member and the bundle of the sheet members into the folding unit;

pressing plates that are provided to form a pair, that have convexly curved surfaces to face each other, and that form a crease at a center portion of the one of the sheet member and the bundle of the sheet members by interposing and pressing the one of the sheet member and the bundle of the sheet members having been pushed into the folding unit therebetween;

a driving unit that performs a pressing operation and a press-releasing operation of the pair of the pressing plates;

a moving unit that moves a pressing position of the pair of the pressing plates interposing the one of the sheet member and the bundle of the sheet members; and a control unit that controls the driving unit and the moving unit, wherein the control unit controls a moving speed of the pressing position moved by the moving unit.

2. The sheet folding device according to claim 1, further comprising:

a detecting unit that detects number of sheet members, wherein the control unit sets the moving speed of the pressing position to a different speed based on the number of the sheet members detected by the detecting unit.

3. The sheet folding device according to claim 1, wherein the control unit sets the moving speed of the pressing position to different speeds between a period when a folding operation is performed and another period when an operation other than the folding operation is performed.

4. The sheet folding device according to claim 1, wherein the control unit changes, depending on the pressing position, the moving speed of the pressing position in a process to form the crease by moving the pressing position.

5. The sheet folding device according to claim 4, wherein the control unit causes the pressing position to pass through the folding unit by making the moving speed of the pressing position slower at a portion in a vicinity of the crease than other portions of the one, of the sheet member and the bundle of the sheet members.

6. The sheet folding device according to claim 1, wherein the control unit causes movement of the pressing position to stop once or more than once in a process to form the crease on the one of the sheet member and the bundle of the sheet members.

7. The sheet folding device according to claim 1, wherein the control unit causes the pair of the pressing plates to repeat the pressing operation and the press-releasing operation a plurality of times in a process to form the crease on the one of the sheet member and the bundle of the sheet members.

8. The sheet folding device according to claim 7, wherein the control unit causes the pair of the pressing plates to perform the pressing operation at a plurality of pressing-position moving speeds while the pressing operation and the press-releasing operation are repeated a plurality of times.

9. An image forming system comprising:

an image forming device that forms a visible image on a sheet member; and a sheet folding device that performs a folding process on one of a sheet member and a bundle of sheet members and that includes:

a folding unit that folds the one of the sheet member and the bundle of the sheet members;

a pushing unit that is formed like a plate and that abuts on a surface of the one of the sheet member and the bundle of the sheet members so as to push the one of the sheet member and the bundle of the sheet members into the folding unit;

pressing plates that are provided to form a pair, that have convexly curved surfaces to face each other, and that form a crease at a center portion of the one of the sheet member and the bundle of the sheet members by interposing and pressing the one of the sheet member and the bundle of the sheet members having been pushed into the folding unit therebetween;

a driving unit that performs a pressing operation and a press-releasing operation of the pair of the pressing plates;

a moving unit that moves a pressing position of the pair of the pressing plates interposing the one of the sheet member and the bundle of the sheet members; and a control unit that controls the driving unit and the moving unit, wherein the control unit controls a moving speed of the pressing position moved by the moving unit.

10. A sheet folding method comprising:

pushing performed by a plate-like pushing unit that pushes one of a sheet member and a bundle of sheet members into a folding unit by abutting on a surface thereof;

interposing the one of the sheet member and the bundle of the sheet members having been pushed into the folding unit by the pushing between a pair of pressing plates whose mutually facing surfaces are convexly curved to each other, pressing a pressed position interposed between the pair of the pressing plates while the pressed position is being moved, and forming a crease at a center portion of the one of the sheet member and the bundle of the sheet members; and changing a moving speed of the pressed position based on sheet information that includes at least one of number of the sheet members, thickness of the sheet members, and a size of the sheet members when the crease is formed by the forming.

* * * * *